US012618640B2

(12) United States Patent
Carlson et al.

(10) Patent No.: US 12,618,640 B2
(45) Date of Patent: May 5, 2026

(54) FIREARMS ACCESSORY DEVICE

(71) Applicant: Laser Aiming Systems Corporation, Maple Plain, MN (US)

(72) Inventors: Casey R. Carlson, Independence, MN (US); Brian Hedeen, Orono, MN (US)

(73) Assignee: Laser Aiming Systems Corporation, Maple Plain, MN (US)

( * ) Notice: Subject to any disclaimer, the term of this patent is extended or adjusted under 35 U.S.C. 154(b) by 0 days.

(21) Appl. No.: 18/953,872

(22) Filed: Nov. 20, 2024

(65) Prior Publication Data

US 2025/0164209 A1 May 22, 2025

Related U.S. Application Data

(60) Provisional application No. 63/601,101, filed on Nov. 20, 2023.

(51) Int. Cl.
*F41C 23/16* (2006.01)
*F41G 1/35* (2006.01)

(52) U.S. Cl.
CPC ..... *F41C 23/16* (2013.01); *F41G 1/35* (2013.01)

(58) Field of Classification Search
CPC ..... F41C 23/16; F41C 23/12; F41G 1/35
USPC ..... 42/90, 113, 114, 117, 106, 72
See application file for complete search history.

(56) References Cited

U.S. PATENT DOCUMENTS 5,622,000 A * 4/1997 Marlowe ..... F41G 1/35 42/117
7,243,454 B1 7/2007 Cahill
7,900,390 B2 3/2011 Moody et al.
D636,837 S 4/2011 Hughes et al.
D643,497 S 8/2011 Fitzpatrick et al.
8,056,277 B2 11/2011 Griffin
8,151,504 B1 4/2012 Aiston
D665,043 S 8/2012 Fitzpatrick et al.
8,245,428 B2 8/2012 Griffin
D668,731 S 10/2012 Fitzpatrick et al.
D669,552 S 10/2012 Essig et al.
D669,553 S 10/2012 Hughes et al.
D670,785 S 11/2012 Fitzpatrick et al.
D678,976 S 3/2013 Pittman
8,438,769 B1 5/2013 Ghannam
D692,517 S 10/2013 Faifer
8,607,492 B2 12/2013 Hartley et al.
D698,885 S 2/2014 Faifer
8,707,604 B2 4/2014 Troy et al.
D712,499 S 9/2014 Pittman
(Continued)

FOREIGN PATENT DOCUMENTS

WO 2020014641 A1 1/2020

*Primary Examiner* — Reginald S Tillman, Jr.

(74) *Attorney, Agent, or Firm* — Christensen, Fonder, Dardi & Busse PLLC; Timothy J. Busse; Andrew H. Auderieth

(57) ABSTRACT

A firearm accessory device removably attachable to a firearm. The accessary device including a finger stop assembly for coupling to a handguard, forestock, barrel or accessory rail of a firearm. The finger stop device may include an illumination device and a power source housed within the device. In embodiments, the device may further include one or more activation devices operably and electrically connected to the illumination device and positioned at an access opening forwardly oriented in a body portion of the device.

20 Claims, 14 Drawing Sheets

(56) References Cited

U.S. PATENT DOCUMENTS

| | | | | |
|---|---|---|---|---|
| D728,054 | S | 4/2015 | Webber | |
| 9,062,933 | B1 * | 6/2015 | Allen | F21V 21/34 |
| 9,182,194 | B2 | 11/2015 | Moore | |
| D745,623 | S | 12/2015 | Flores | |
| D745,624 | S | 12/2015 | Flores | |
| D745,629 | S | 12/2015 | Barfoot et al. | |
| D745,940 | S | 12/2015 | Flores | |
| 9,228,798 | B1 | 1/2016 | Viola | |
| 9,228,804 | B2 | 1/2016 | Syrengelas et al. | |
| D755,333 | S | 5/2016 | Kielsmeier et al. | |
| D755,334 | S | 5/2016 | Kielsmeier et al. | |
| 9,423,208 | B1 | 8/2016 | Mahmalji | |
| D779,017 | S | 2/2017 | Liu | |
| D783,757 | S | 4/2017 | Jen | |
| D785,744 | S | 5/2017 | Bosco et al. | |
| D786,383 | S | 5/2017 | Saadon | |
| D786,384 | S | 5/2017 | Saadon | |
| D790,650 | S | 6/2017 | Saadon | |
| D790,651 | S | 6/2017 | Saadon | |
| 9,696,111 | B2 | 7/2017 | Saadon | |
| 9,709,356 | B1 | 7/2017 | Anstett et al. | |
| D803,966 | S | 11/2017 | Saadon | |
| D803,967 | S | 11/2017 | Saadon | |
| D803,968 | S | 11/2017 | Saadon | |
| D803,969 | S | 11/2017 | Saadon | |
| D803,971 | S | 11/2017 | Saadon | |
| D804,604 | S | 12/2017 | Shelton et al. | |
| 9,841,254 | B2 | 12/2017 | Moore | |
| 9,891,020 | B2 | 2/2018 | Jen | |
| 10,082,363 | B2 | 9/2018 | Burgess | |
| D837,926 | S | 1/2019 | Christian | |
| 10,190,840 | B1 | 1/2019 | Renteria | |
| D841,756 | S | 2/2019 | Saadon | |
| D842,416 | S | 3/2019 | Saadon | |
| 10,222,171 | B2 | 3/2019 | Chavez | |
| 10,260,841 | B2 | 4/2019 | Kincel et al. | |
| 10,267,594 | B2 | 4/2019 | Saadon | |
| D860,375 | S | 9/2019 | Chavez | |
| D873,369 | S | 1/2020 | Shelton et al. | |
| D876,570 | S | 2/2020 | Saadon | |
| 10,845,157 | B2 * | 11/2020 | Chavez | F41C 23/16 |
| 2004/0003529 | A1 | 1/2004 | Danielson | |
| 2005/0130739 | A1 | 6/2005 | Argentar | |
| 2007/0039226 | A1 | 2/2007 | Stokes | |
| 2009/0178325 | A1 | 7/2009 | Veilleux | |
| 2010/0229448 | A1 | 9/2010 | Houde-Walter et al. | |
| 2011/0047850 | A1 | 3/2011 | Rievley et al. | |
| 2011/0047851 | A1 | 3/2011 | Mock et al. | |
| 2011/0107643 | A1 | 5/2011 | Fitzpatrick et al. | |
| 2014/0196342 | A1 | 7/2014 | Syrengelas et al. | |
| 2015/0135573 | A1 | 5/2015 | DiChario | |
| 2015/0233668 | A1 | 8/2015 | Moore | |
| 2016/0245617 | A1 | 8/2016 | Moore | |
| 2016/0290760 | A1 | 10/2016 | Jen | |
| 2017/0082399 | A1 | 3/2017 | Moore et al. | |
| 2017/0097208 | A1 | 4/2017 | Hebden et al. | |
| 2019/0222771 | A1 | 7/2019 | Hedeen et al. | |
| 2019/0376762 | A1 | 12/2019 | Saadon | |

* cited by examiner

FIREARMS ACCESSORY DEVICE

CROSS-REFERENCE TO RELATED APPLICATIONS

This application claims the benefit of U.S. Provisional Patent Application No. 63/601,101, filed Nov. 20, 2023, entitled "Firearm Accessory," the entirety of each of which is incorporated by reference herein.

TECHNICAL FIELD

The present disclosure relates to firearm accessory devices for mounting on a firearm.

BACKGROUND

Many firearms, particularly rifles, are controlled with the non-firing hand receiving a hand guard surrounding the firearm barrel. Grasping the firearm can be awkward and uncomfortable for users, particularly in extended firing sessions. Standardized mounting rails have made it possible to mount a wide variety of accessories to a firearm. Weapon-mounted firearm accessories have become an important tool for military, police, and civilian firearm users. Presently, many shooters utilize different accessories to enhance their firearm and provide additional functionality which allows for improved firearm utilization. One such accessory is the firearm foregrip. A firearm foregrip is typically attached onto a handguard rail via different mechanisms and vertically oriented or angled. Foregrips usually include an elongated handle that can be gripped by the hand not operating the trigger. Such conventional firearm foregrips may provide additional support and control, they can however become uncomfortable and awkward for users, particularly in extended firing sessions. Any improvements with respect to ergonomic functionality and the ability to employ different support hand holding techniques would be welcome.

In one or more embodiments, the accessory devices disclosed herein are further advantageous in that they include ergonomic features configured to maximize user comfort, accuracy and safety.

SUMMARY

The present disclosure relates to firearm accessory devices for mounting on a firearm, in particular, a hand/finger support/stop having an illumination device for coupling to a handguard, forestock, barrel or accessory rail of a firearm. In one or more embodiments, an accessory device that may be attached to a firearm, the device including a light source and a power source housed within the device. In embodiments, the device may further include one or more activation devices operably and electrically connected to the illumination device and positioned at one or more access openings forwardly oriented in a body portion of the device.

In one or more embodiments, there is disclosed herein an accessory device for a firearm. In embodiments, the device may include a housing removably attachable to the firearm, wherein the housing includes a body portion downwardly extending from a cover portion and including a first trunk portion and forward and rearward portions oppositely extending from an upper portion of the first trunk portion. In embodiments, the forward portion each may have one or more tapered neck portions between the first trunk portion and a forward end portion.

In one or more embodiments, the forward portion includes a second trunk portion extending downwardly forward of the first trunk portion. The forward portion may include a first tapered neck portion between the first trunk portion and the second trunk portion and a second tapered neck portion between the second trunk portion and a forward end portion.

In one or more embodiments, the device may further include an aperture formed in the forward end of the housing, an illumination device positioned within the housing and configured to emit light through the aperture and a first activation device. In embodiments, the first activation device and the forward, rearward and first and second trunk portions may each intersect a common plane. The first activation device may be accessible from outside of the housing, through the wall of the body portion, and be operably (electrically) connected to the illumination device and a power supply, wherein engagement with the first activation device directs power from the power supply to the illumination device. In one or more embodiments, the illumination is an LED illumination device and the device further includes a coupling mechanism for coupling the housing to the firearm.

In one or more embodiments, the first activation device at least partially extends through a first opening in the housing wall of the second trunk portion at an acute angle between the housing axis and a line through and perpendicular to the first opening. In embodiments, the acute angle may be in the range of about 36 degrees to about 56 degrees. In some embodiments, the acute angle may be in the range of about 41.00 degrees to about 51.00 degrees, and in one or more embodiments, the acute angle is about 46.50 degrees.

In one or more embodiments, the housing includes structure within the wall, wherein the structure defines compartments, chambers, mounts and/or seats for containing electronic components and a power source. In some embodiments, the structure is integral with the housing wall.

In one or more embodiments, there is disclosed herein a device removably attachable to a firearm having a body, an inner chamber, an activation device, and a coupling mechanism. The body includes a middle tapered neck portion between a forward trunk portion and a rearward trunk portion and a forward tapered neck portion between the forward trunk portion and a forward end portion. The forward trunk portion and the rearward trunk portion each include an upper portion and a lower portion. When the device is mounted to the firearm, the upper portion of each of the forward trunk portion and the rearward trunk portions are proximal to the firearm. In some embodiments, an outermost cross-sectional perimeter of the forward end portion is greater than any cross-sectional perimeter of the forward tapered neck portion.

The inner chamber is defined by a wall of the body and may be configured to receive an illumination device therein. The activation device extends through the body portion and is configured to direct power from a power supply to the illumination device. The coupling mechanism couples the house to the firearm.

In one or more embodiments, there is disclosed herein an illumination device including a housing, an illumination device, and an activation device. The housing defines an inner chamber and has a first trunk portion vertically oriented between an upper portion and a lower portion. A forward portion extends forward from the first trunk portion. A second trunk portion is oriented forward of the first trunk portion and extends from the forward portion. A forward neck portion is positioned between the second trunk portion and a forward end portion. A rearward neck portion is positioned between the first trunk portion and the second trunk portions. When viewed from a side profile perspective, the housing forms a first forward arc having an arc length from a forward end to a rearward end. The first forward arc has a positive curvature along its arc length relative to a forward center or forward center of curvature. The illumination device is disposed within the inner chamber defined by a wall of the housing. The activation device is accessible from outside of the housing, through a forward activator access opening in the wall of the body portion of the housing. The activation device is connected to the illumination device and a power supply, such that engagement with the first activation component directs power from the power supply to the illumination device.

In one or more embodiments, the accessory devices disclosed herein are further advantageous in that they include ergonomic features configured to maximize user comfort, accuracy and safety. In one or more embodiments, the accessory devices disclosed herein are further advantageous in that they are configured for ambidextrous activation. In one or more embodiments, the accessory devices disclosed herein are further advantageous in that they are configurable for multiple modes including a constant-on mode, ensuring readiness and conserving battery life during inactivity, and high and low modes with grip activation for momentary usage.

The above summary is not intended to describe each illustrated embodiment or every implementation of the present disclosure.

BRIEF DESCRIPTION OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figure 1:
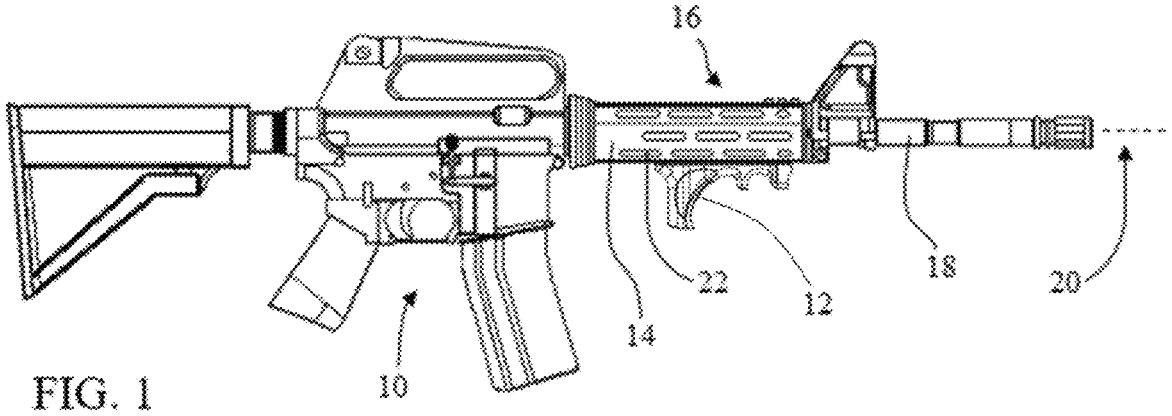
FIG. 1 depicts a side elevation view of a firearm with an accessory device attached thereto, according to one or more embodiments of the disclosure.

While the embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

Referring to FIG. 1, a side view of a firearm 10 with an attached accessory device 12 is depicted, in accordance with one or more embodiments of the disclosure. In one or more embodiments, the firearm 10 may include, among other various components, a rail interface system comprising a handguard 14 mounted on a forend portion 16 of the firearm 10 and a barrel 18 extending therethrough along a bore axis 20. In embodiments, surrounding the handguard 14 are a plurality of elongated open slots 22 in the handguard 14 and a void space between the handguard 14 and the barrel 18. In one or more embodiments, as shown in FIG. 1, accessory device 12 may be coupled to one or more of the elongated open slots 22 at the bottom of the handguard 14.

In embodiments, the accessory device 12, as illustrated in FIG. 1, may be mounted and secured to a firearm using a rail interface system of the M-LOK "negative space" design. However, in embodiments, accessory device 12 may be mounted and secured to a firearm using various known rail interface systems configured to accommodate a variety of different accessories and attachments. As such, the firearm 10 and interface system depicted in FIG. 1 is meant for illustrative purposes and not meant to be limiting. While the accessory device 12 is shown as attached to a specific location of the handguard 14, it may be attached to other attachment points on the firearm 10.

Figure 2A:
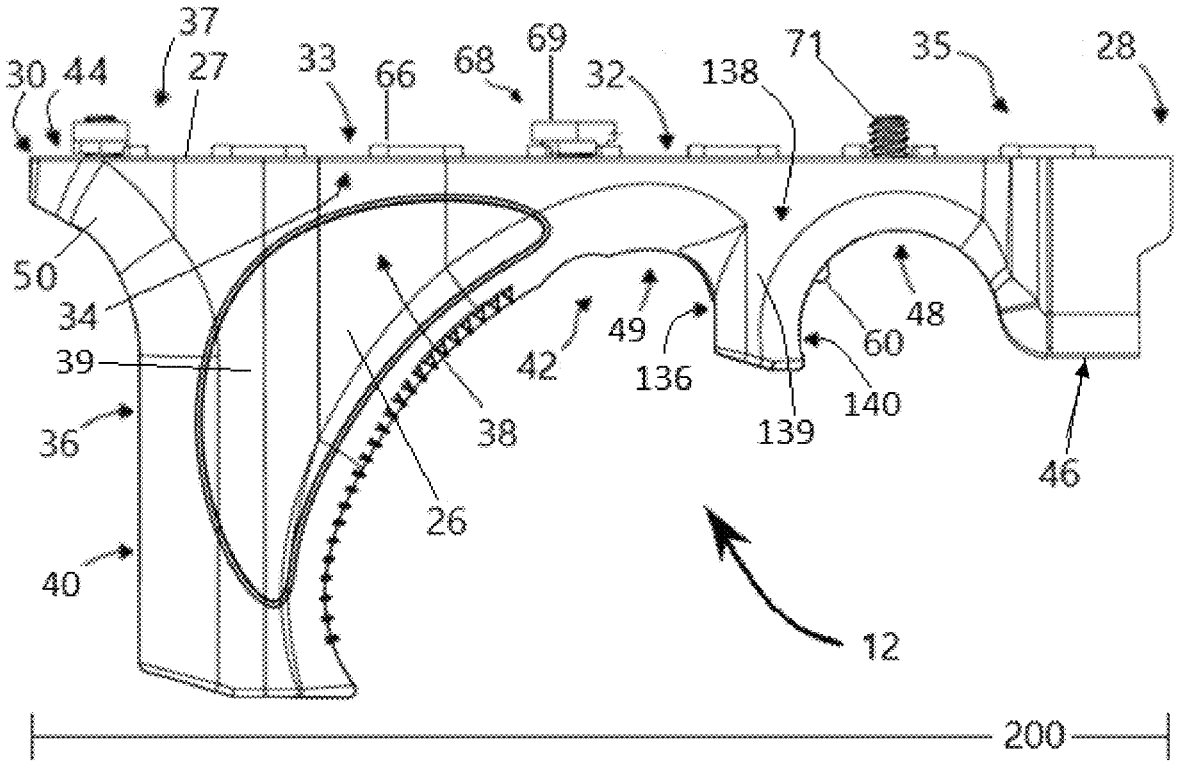
FIG. 2A depicts a right-side elevation view of an accessory device, according to one or more embodiments of the disclosure.
Figure 2B:
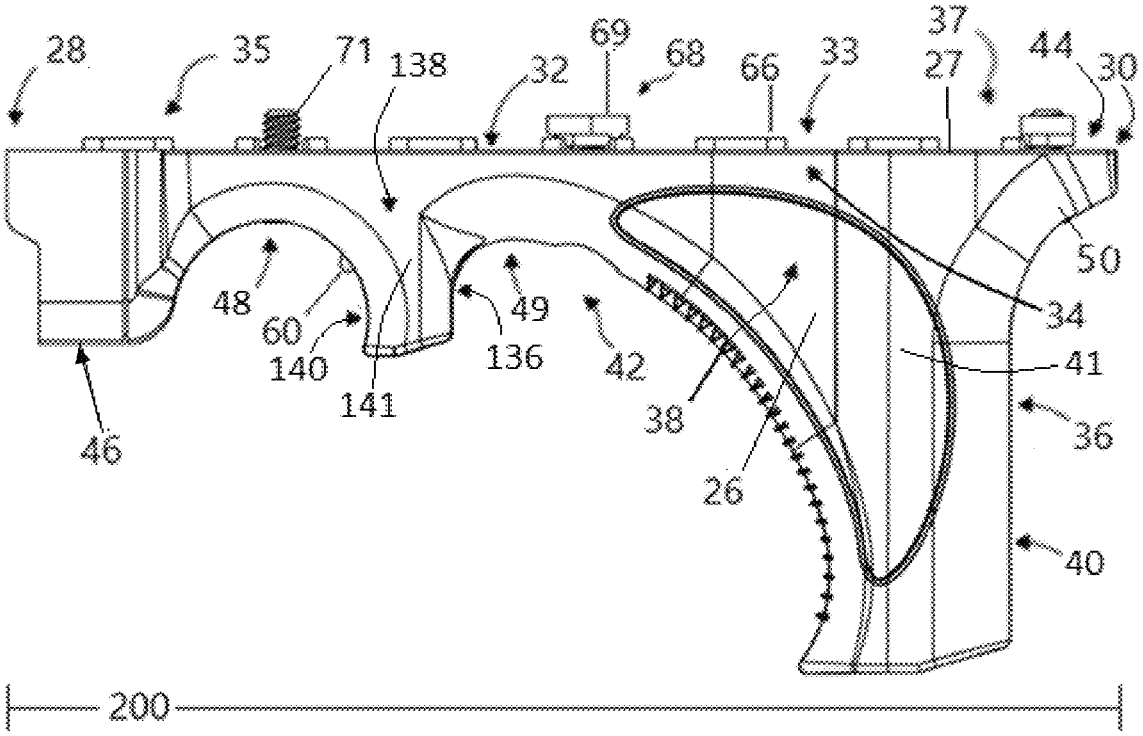
FIG. 2B depicts a left-side elevation view of the device of FIG. 2A, according to one or more embodiments of the disclosure.
Figure 2C:
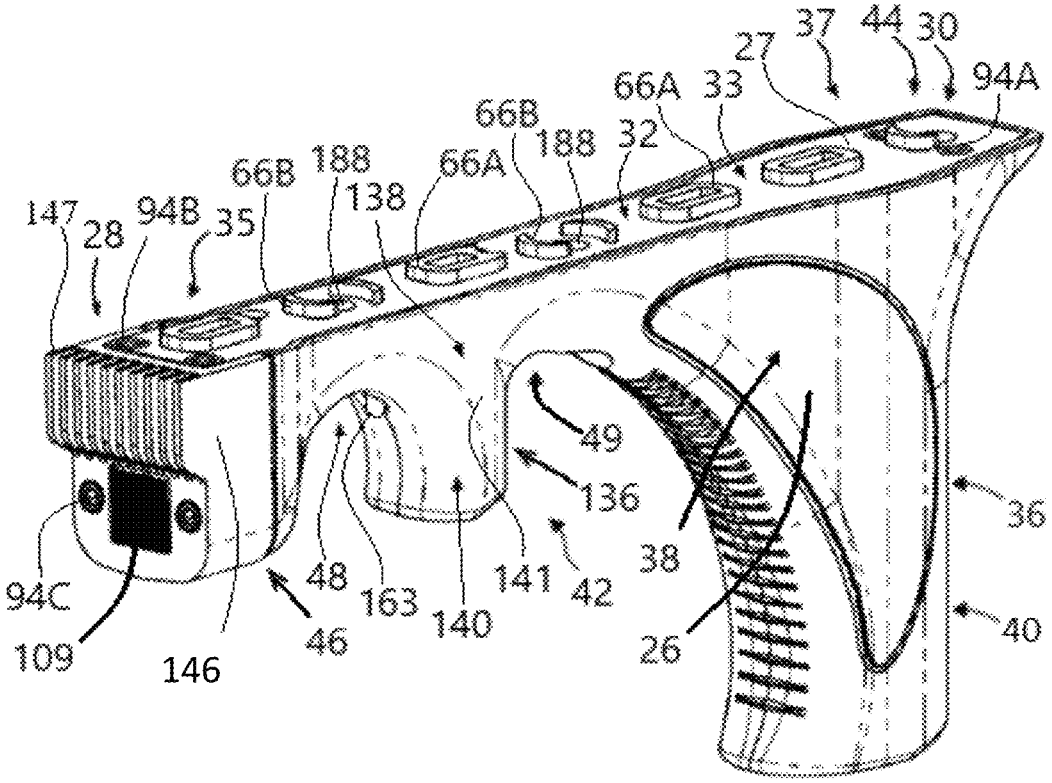
FIG. 2C depicts a left-side, top, front perspective view of the device of FIG. 2A, according to one or more embodiments of the disclosure.
Figure 2D:
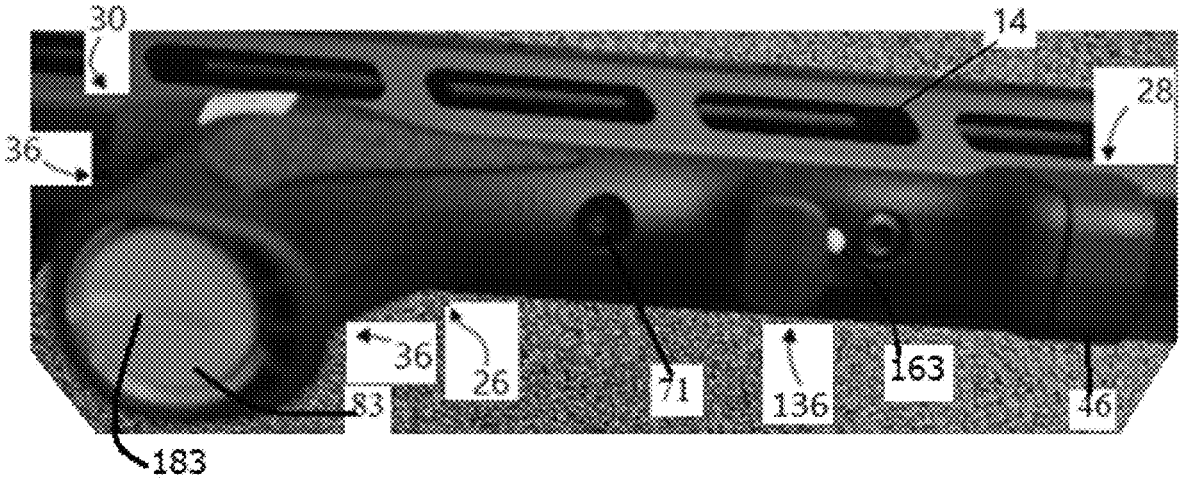
FIG. 2D depicts a bottom perspective view of the device of FIG. 2A, according to one or more embodiments of the disclosure.
Figure 2E:
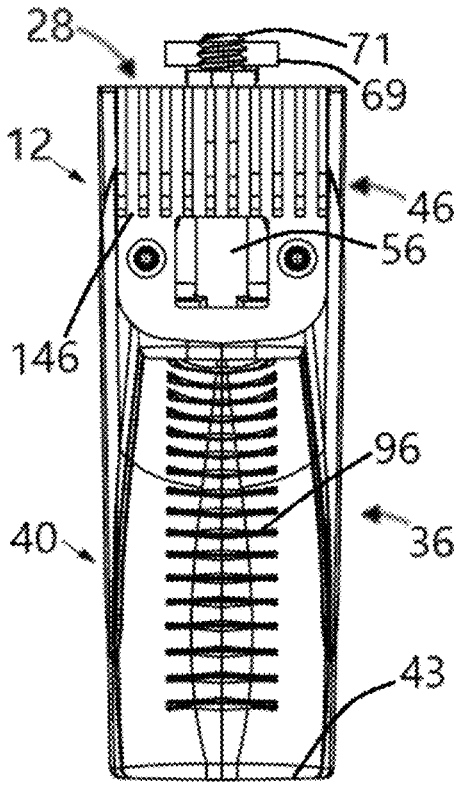
FIG. 2E depicts a front view of the device of FIG. 2A, according to one or more embodiments of the disclosure.
Figure 2F:
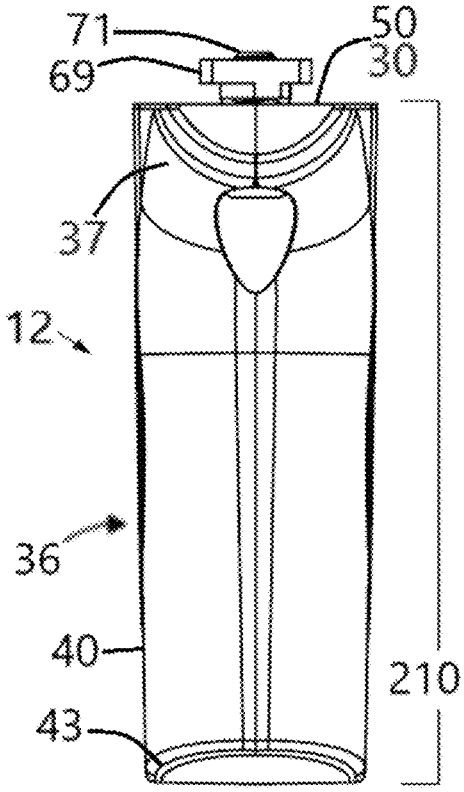
FIG. 2F depicts a rear view of the device of FIG. 2A, according to one or more embodiments of the disclosure.
Figure 2G:
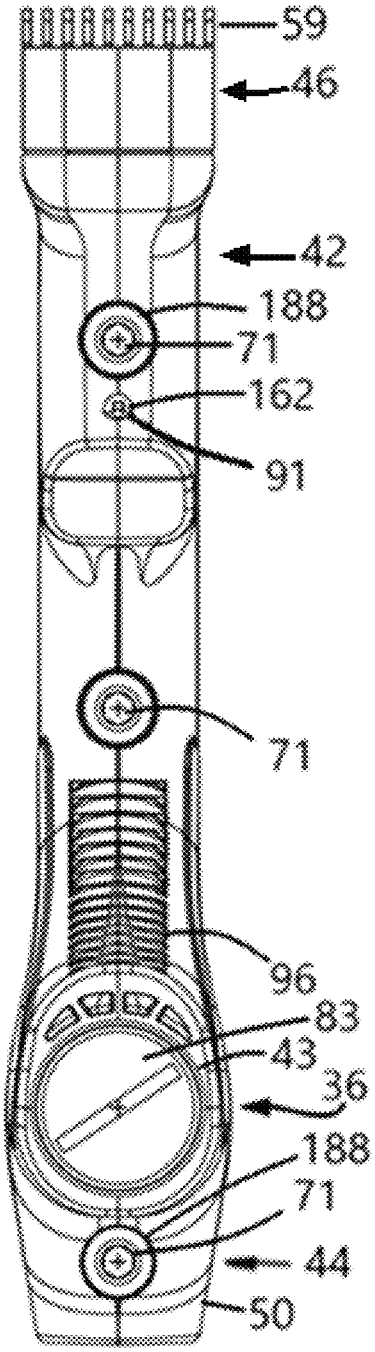
FIG. 2G depicts a bottom plan view of the device of FIG. 2A, according to one or more embodiments of the disclosure.
Figure 2H:
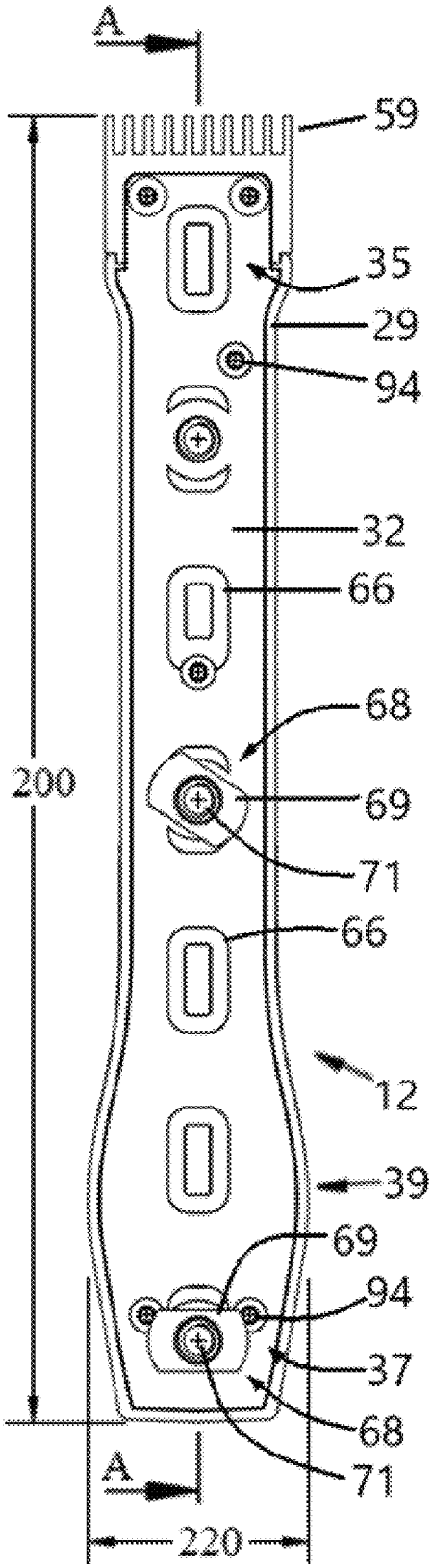
FIG. 2H depicts a top plan view of the device of FIG. 2A, according to one or more embodiments of the disclosure.
Figure 3:
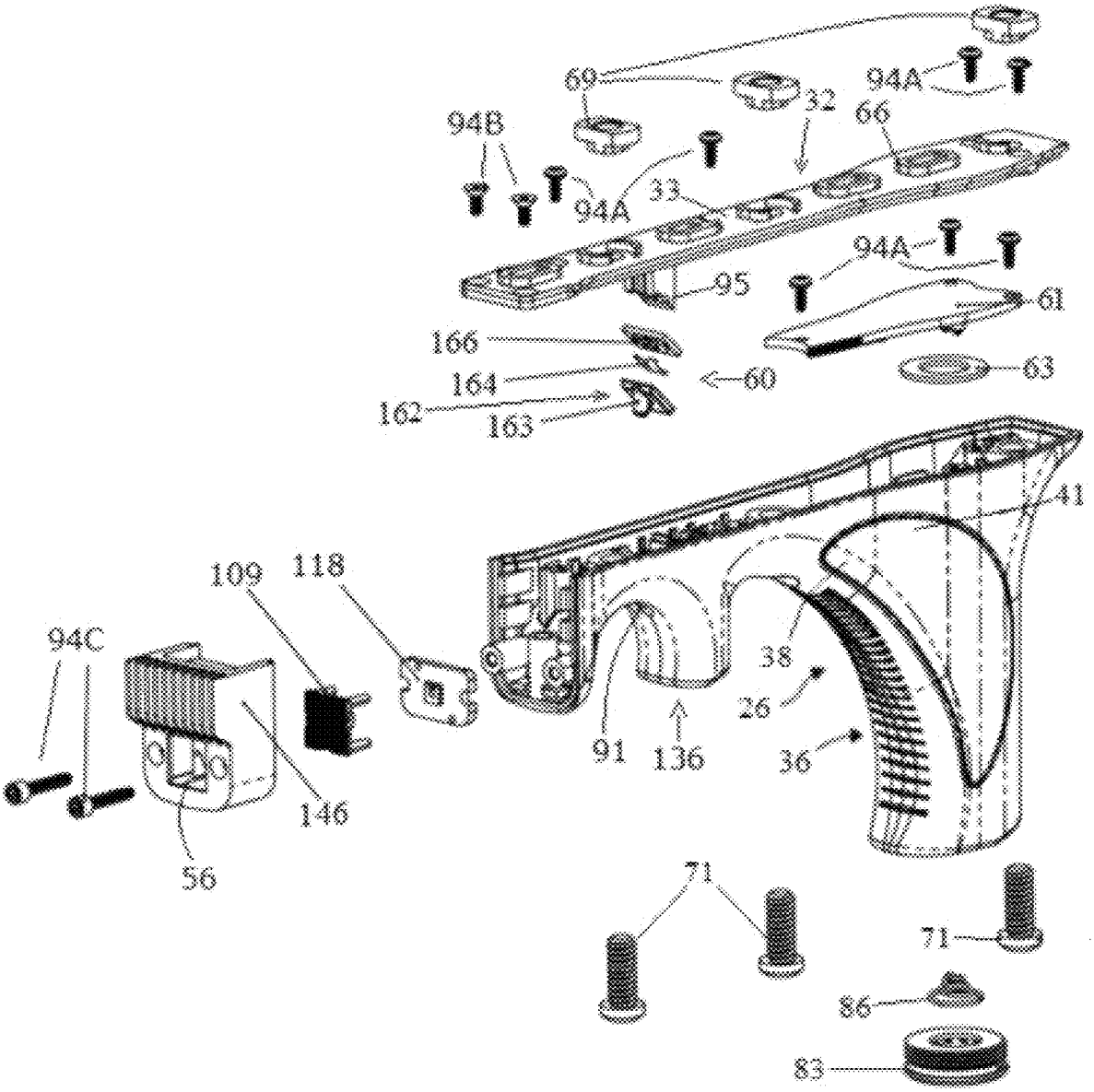
FIG. 3 depicts a front, left-side, top perspective exploded view of the device of FIG. 2A, according to one or more embodiments of the disclosure.

Referring to FIGS. 2A-2H, various views of a firearm accessory device 12 are depicted, in accordance with one or more embodiments of the disclosure. FIG. 3 is an exploded front left side perspective view of device 12 and illustrates assembly and positioning of various components of device 12 in accordance with one or more embodiments of the disclosure.

As shown in FIGS. 2A-2H, in one or more embodiments, the device 12 has a length 200 extending from a forward end 28 to a rearward end 30, a height 210 and includes a body portion 26 and a cover portion 32, the cover portion 32 being coupled to an upper portion 34 of the body portion 26. Alternatively, or additionally, the cover portion 32 is uniform with the body portion 26. In one or more embodiments, the body portion 26 includes an upper rim 27 defining an upper opening 31, wherein the upper rim 27 may form an upper rim surface 29. In embodiments, the cover portion 32 includes an upper face portion 33 and extends from a forward portion 35 to a rearward portion 37 between or to the forward and rearward ends 28, 30, of the device 12.

In one or more embodiments, the body portion 26 includes a first or rear trunk portion 36, a forward portion 42 forwardly extending from the trunk portion 36 and a rearward portion 44 rearwardly extending from the trunk portion 36. The trunk portion 36 may include an upper body portion 38, a lower body portion 40 and right and left side portions 39, 41. In embodiments, the lower body portion 40 may include a lower rim 43 defining a lower opening 45. Device 12 may further include a lower or distal cap 83 coupled to lower body portion 40 and covering lower opening 45.

In one or more embodiments, the forward portion 42 includes a forward end portion 46, a second or forward trunk portion 136 positioned between the forward end portion 46 and the first trunk portion 36, a first or forward tapered or neck portion 48 positioned between the forward end portion 46 and the second trunk portion 136, and a second or rearward tapered or neck portion 49 positioned between the first and second trunk portions 36, 136. The rearward portion 44 may be a tapered rearward end portion 50.

In one or more embodiments, the forward portion 42 includes a second or forward trunk portion 136, The second trunk portion 136 may include an upper body portion 138, a lower body portion 140 and right and left side portions 139, 141.

In one or more embodiments, the forward end portion 46 may include a forward-facing aperture 56. In one or more embodiments, the aperture 56 provides an outlet for illumination emitted from an illumination device disposed within the body portion 26.

In one or more embodiments, the illumination device 104 may be a light emitting diode (LED) illumination device 118. In embodiments, the LED illumination device 118 may include a printed circuit assembly (PCA) LED board having an LED 118 disposed within the body portion 26. Forward end portion 46 may include a lens 109 positioned in the forward-facing aperture 56. In one or more embodiments, the LED illumination device 104 and lens 109 may be arranged such that, when activated, the LED illumination device 104 emits light through the lens 109. In embodiments, the lens may be an elliptical ripple linear TIR LED lens and the LED may be an 5000K LED.

Device 12, in one or more embodiments, further includes a plurality of access portions or openings 88 located in access positions on/in the device 12 and one or more activator/actuator access portions or openings 91. In one or more embodiments, device 12 includes one or more activation elements/components 60 extending through opening(s) 91. In the embodiment shown in FIGS. 2A-4, device 12 includes a forward oriented activation component 60 accessible via a forward oriented activator access portion 91, which may be an opening. The embodiment shown includes an activation component 60 having a forward activator or actuator 162, wherein a protrusion portion 163 of the forward activator 162 protrudes or is accessible through activator access opening 91. In embodiments, forward activator 162 may be used, by engaging, depressing or otherwise triggering, for activating one or more electronic components of device 12.

In one or more embodiments, device 12 may further include a pattern of raised portions 96 on the outer surface 74 of body portion 26. Raised portions 96 may provide increased traction and a more tactile feel, enhancing the user's engagement with the device 12. In an embodiment, the raised portions 96 are patterned as shown in the figures. In one or more embodiments, raised portions 96 may define various geometric shapes, including, for example, lines, circles and polygons. In embodiments, raised portions 96 may be formed as an integral portion of the body portion 26. In one or more embodiments, raised portions 96 may be formed of a resilient elastomeric material.

In one or more embodiments, device 12 further includes a mounting assembly 64 that may be used for coupling device 12 to a firearm accessory rail or handguard 14 and maintaining device 12 in a select position relative to the rail or handguard 14. In one or more embodiments, the mounting assembly 64 illustrated is configured to couple to a rail interface system utilizing a firearm accessory rail or handguard 14, as illustrated in FIG. 1, that includes a plurality of elongated slots 22.

In the embodiment illustrated FIGS. 2A-4, mounting assembly 64 may comprise a locking mechanism 67 comprising one or more fastener assemblies 68 that may work in conjunction with one or more mounting interfaces 66 disposed or formed on the upper face portion 33 of cover 32. Each fastener assembly 68 may comprise a mounting fastener 69 and a mounting bolt 71. As an example, the fastener 69 may be a T-nut or a M-LOK Nut. In embodiments, mounting bolts 71 may be sized and configured to extend from the body portion 26 through an opening in the upper face 33 of the upper cover portion 32. In one or more embodiments, fasteners 69 are received, along with mounting interface 66, through open slots 22 in the handguard 14 into voids between the handguard 14 and the barrel 18 to both clamp the fastener assemblies 68 to the handguard 14 and further to prevent movement of the device 12 on the firearm 10.

In an embodiment, mounting fasteners 69 are configured to rotate ninety degrees (90°) between a locked position (in which aligns with the slot and can pass through the slot) and an unlocked position (in which it extends across the slot) to facilitate coupling the firearm accessory to the firearm accessory rail. The mounting bolt 71 is rotatably coupled to the mounting fastener 69 for rotating the mounting fastener 69 between the locked position and the unlocked position. In an embodiment, the locking mechanism 67 includes a pair of fastener assemblies 68. In another embodiment, the locking mechanism 67 may include any suitable number of fastener assemblies 68 to couple the firearm accessory device 12 to the firearm 10 and/or the firearm accessory rail or handguard. In an embodiment, the mounting assembly 64 may be a Magpul M-Lock compatible system (MLOK system) having standardized mounting interface and fasteners.

FIG. 3 is an exploded view of device 12 illustrating the assembly and positioning of various components of device 12 in one or more embodiments.

FIGS. 4A-4D show a body portion 26 in accordance with one or more embodiments of the disclosure. In embodiments, body portion 26 may include a wall 72 having an outer surface 74 and an inner surface 76 and defining an upward facing receptacle portion 78 bounded by the upper rim 29 and exposed through upper opening 31. In one or more embodiments, wall 72, at lower body portion 40, further defines a lower chamber/compartment 80 bounded by the lower rim 43 and exposed through lower opening 45. In one or more embodiments, receptacle portion 78 extends in upper body portion 34 from rearward portion 44 to forward portion 42 and, when cover portion 32 is coupled to upper portion 34, forms an upper inner chamber/compartment 79. In embodiments, receptacle portion 78 may be exposed or opened to lower chamber/compartment 80.

In one or more embodiments, body portion 26 may comprise inner framework structure 90 extending from inner surface 76 into receptacle portion 78. In embodiments, framework structure 90 may define a plurality of seats 92 for receiving electronic components 102 in assembly of device 12, as illustrated, for example, in FIGS. 3 and 4C.

In embodiments, lower compartment/chamber 80 may be sized and configured to receive a power source and may include a threaded portion 81 for engaging lower cap or cover 83. Lower cap or cover 83 is inserted to and covers the lower opening 45. In one or more embodiments, device 12 may further include an inner sleeve 82 positioned within lower compartment 80, the inner sleeve 82 defines a receptacle/chamber/compartment 80A being sized and configured to receive the power source. In embodiments, inner sleeve 82 may be secured within the lower compartment via an interference fit. In an embodiment, inner sleeve 82 may include an outer retaining ring 85 that mates with an inner retaining ring groove 87 formed in the inner surface 76 of the wall defining the lower compartment 80. In embodiments, inner sleeve 82 may further include an inner threaded portion 81 for engaging lower cap or cover 83. In embodiments, inner sleeve 82 may be formed of a conductive material, which may be, for example, brass or copper. In embodiments, the inner metal sleeve 82 may be formed of or comprises a brass material. In one or more embodiments, the inner sleeve 82 is an overmolded brass tube, which may be configured for battery contact.

Figure 6:
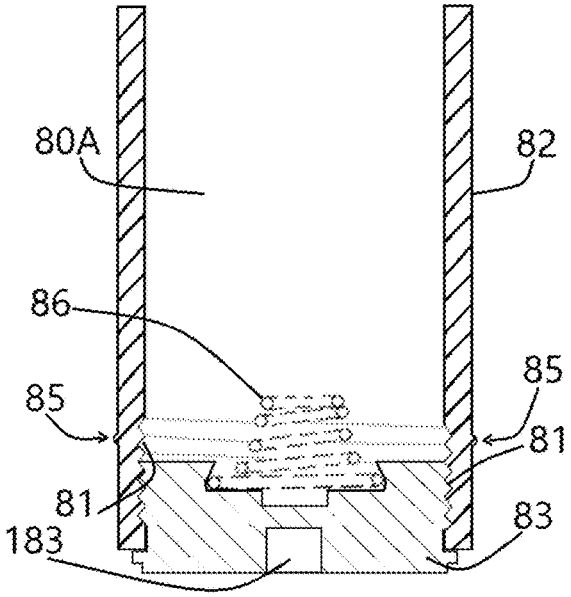
FIG. 6 depicts a cross-sectional side perspective view of a power source assembly of the device of FIG. 2A, according to one or more embodiments of the disclosure.
Figure 7:
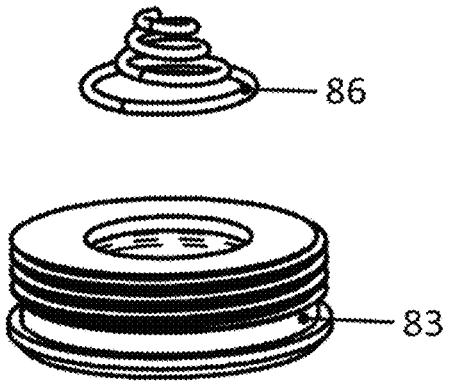
FIG. 7 depicts a side top perspective view of a lower cap and spring of the device of FIG. 2A, according to one or more embodiments of the disclosure.

In one or more embodiments, a power source may be inserted and positioned in the lower compartment 80, within inner sleeve 82. The power source 84 may be covered and secured within the lower compartment by lower cap 83. In embodiments, device 12 may further include a biasing element 86 positioned between the power source 84 and the lower cap 83, as illustrated in FIGS. 3 and 6. In an embodiment, as an example, biasing element 86 may be a metal spring. In embodiments, the lower cap 83 may be slotted 183 to facilitate insertion, tightening and removal of lower cap 83, as illustrated in FIGS. 2D and 6.

In one or more embodiments, the power source 84, such as a battery, is electrically connected by terminals in the power source compartment to illumination driving circuitry. The illumination driving circuitry is also electrically connected to illumination device 104, which may be an LED illumination device and flexible circuitry. In embodiments, the illumination device 104 may include, in alternative or in addition, a laser diode, as described in U.S. patent application Ser. No. 17/465,839, which is herein incorporated by reference in its entirety.

In one or more embodiments, device 12 includes inner sleeve 82, wherein the inner sleeve 82 is a metal housing inserted into the lower compartment 80. The metal housing 82 is sized and configured to receive power source 84, for example, a battery. In one or more embodiments, metal housing 82 comprises at least a portion of an electrical path between the inserted power source 84 and one or more electronic components 102. In embodiments, the metal housing 82 may be a brass tube and overmolded in the formation of body portion 26. In one or more embodiments, the power source 84 includes a built-in rechargeable battery. In embodiments, the power source may be a ⅓N battery or the like.

In one or more embodiments, aperture 56 provides an outlet for illumination emitted from an illumination device 104 disposed within the body portion 26. In embodiments, aperture 56 may be positioned in a forward-facing wall portion of the forward end portion 46, at or adjacent to a bisecting plane running through forward and rearward end portions 46, 44, between left and right side body portions 34, 36, providing forward facing access to electronic components housed within body portion 26. In embodiments, forward-facing aperture 56 may be covered by a transparent material. In embodiments, in addition to forward facing aperture 56, body portion 26 may further include one or more apertures or outlets for additional electron components, including, for example, further illumination devices, such as a laser device, and/or recording devices.

In one or more embodiments, body portion 26 may further include one or more of access positions or portions in wall 72 of body portion 26, providing access to activating and/or adjustment components of device 12. In embodiments, access positions or portions may comprise openings and/or thinned or pressure sensitive portions exposed in the wall 72 of body portion 26. In one or more embodiments, body portion 26 includes a plurality of access portions including one or more activator access openings 91 providing access to one or more activation components 60 for activating one or more electronic components of device 12.

In embodiments, the body portion 26 may further include a plurality of openings 188 through wall 72 for receiving therethrough connectors and/or fasteners 71, 94, for example, bolts 71 and screws 94 (94A-94C), for coupling upper cover portion 32 to body portion 26 and device 12 to a firearm. As an example, fasteners 94 may include round head thread forming screws 94A, which may be about 4.5 mm in length, #1-64, FH, alloy, black oxide screws 94B, which may be 3⁄16 inch, and #2-28, TF, SHCS, 6IP screws 94C, which may be 7⁄16 inch.

Figure 4A:
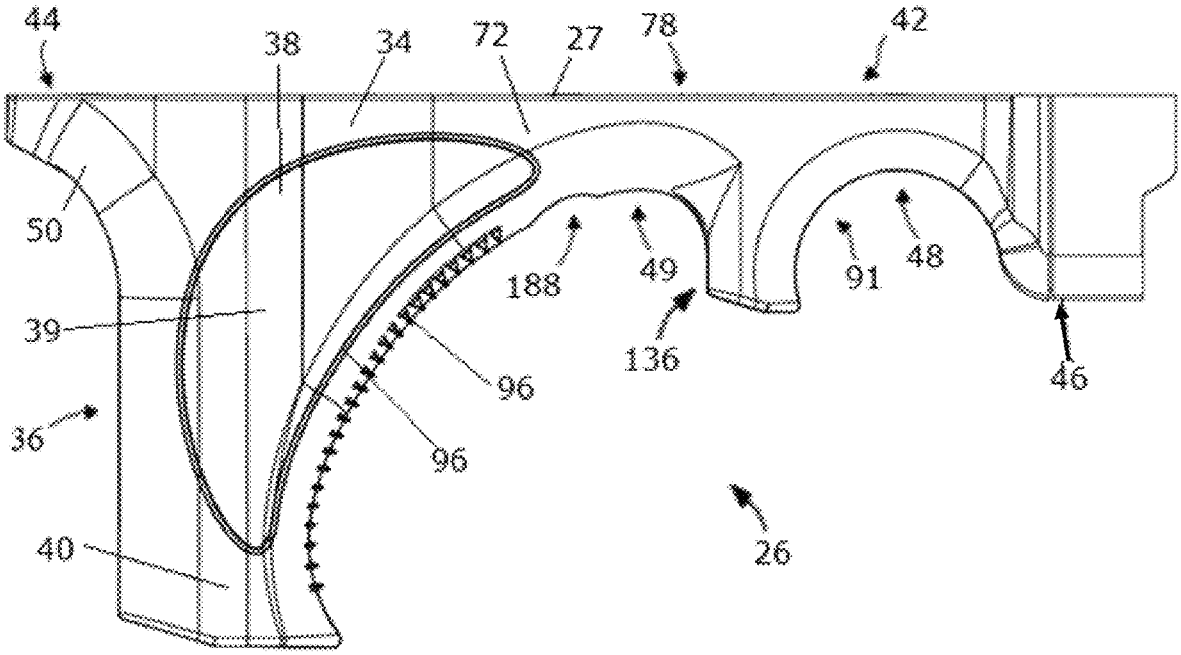
FIG. 4A depicts a right-side elevation view of a body portion of the device of FIG. 2A, according to one or more embodiments of the disclosure.
Figure 4B:
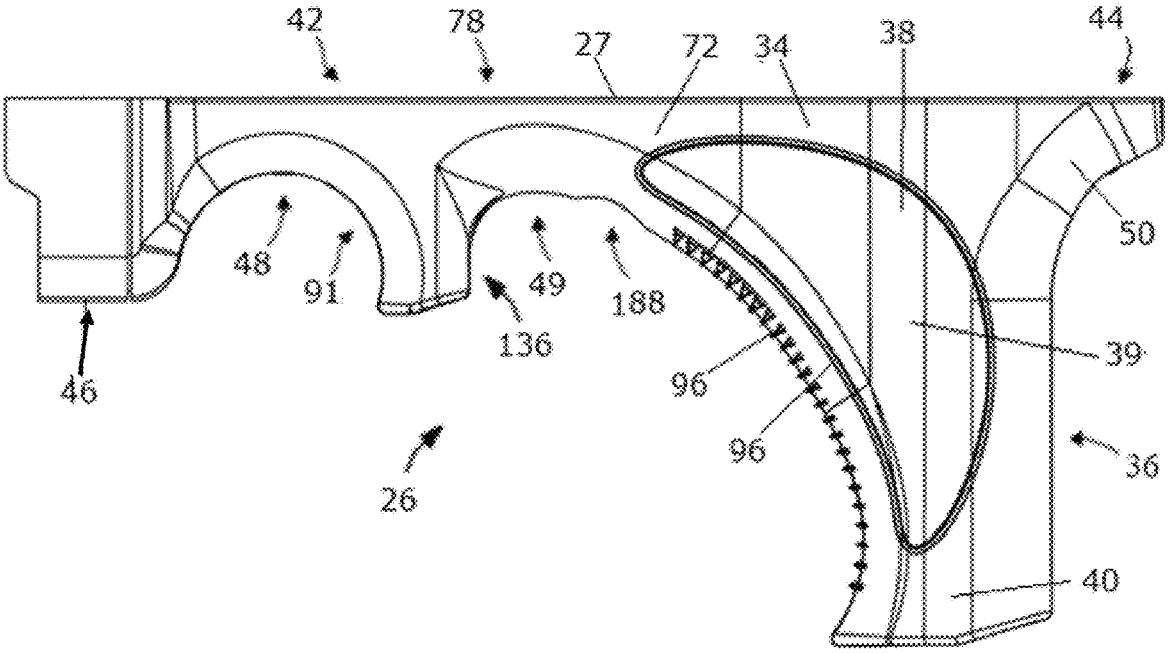
FIG. 4B depicts a left-side elevation view of the body portion of FIG. 4A, according to one or more embodiments of the disclosure.
Figure 4C:
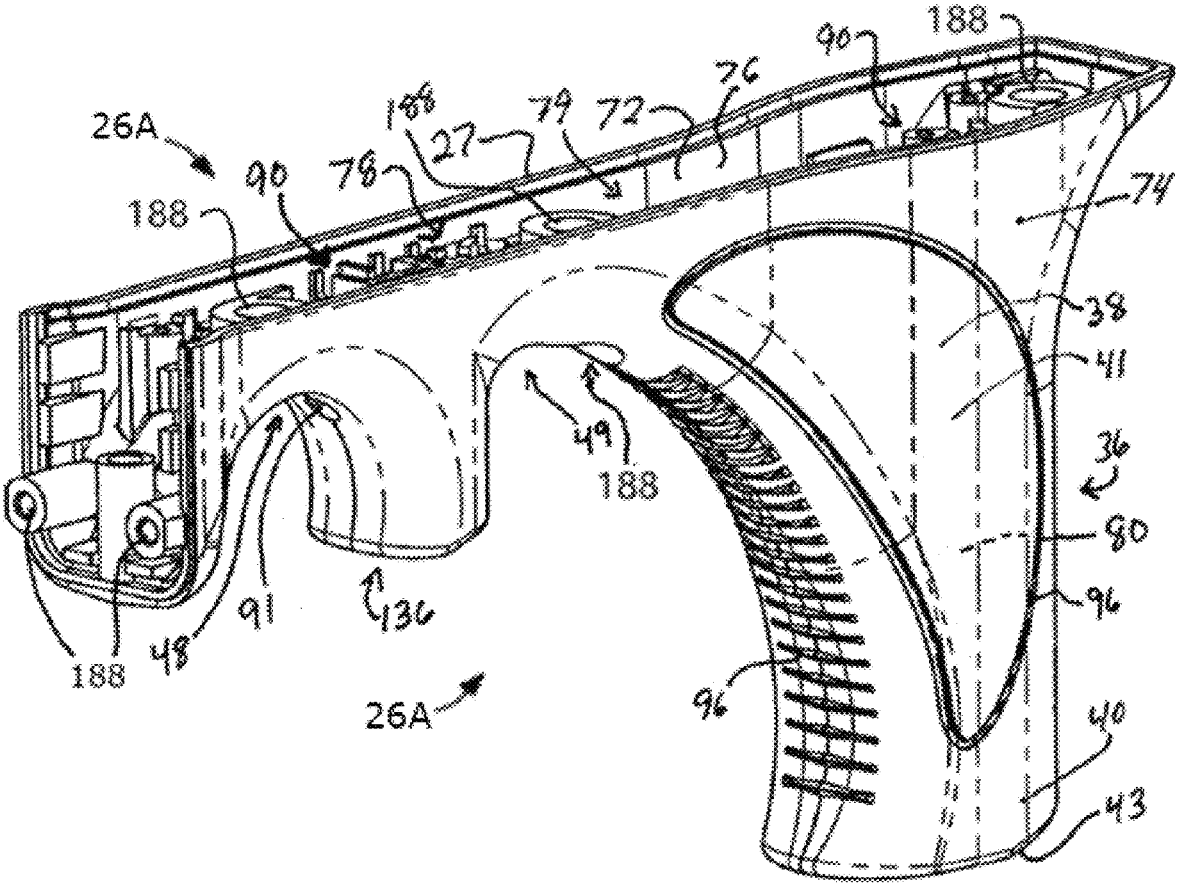
FIG. 4C depicts a left-side, top, front perspective view of a main body portion of the body portion of FIG. 4A, according to one or more embodiments of the disclosure.
Figure 4D:
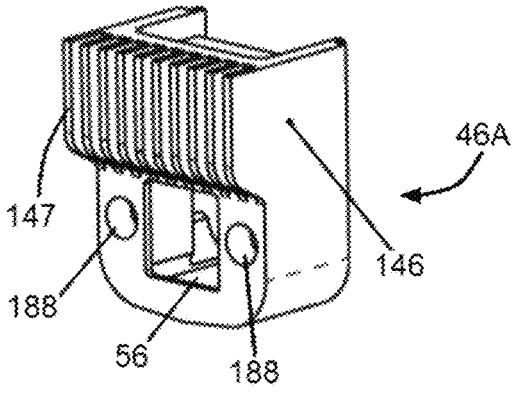
FIG. 4D depicts a left-side, top, front perspective view of a forward end portion of the body portion of FIG. 4A, according to one or more embodiments of the disclosure.

In one or more embodiments, body portion 26 may comprise a main body portion 26A and forward end portion 46 may comprise a forward end piece 46A, which may be separatable from the main body portion 26A, as illustrated in FIGS. 4C-4D. In one or more embodiments, the forward end piece 46A component comprises a thermal management component 146, which may comprise a heat sink. In embodiments, the heat sink may be constructed, configured, and positioned for dissipating and regulating heat generated by components within the accessory device 12 and to protect the internal components of the accessory device from external heat and energy sources. In one or more embodiments, the heat sink 146 may include fins 147 and be shaped, configured and positioned as shown in the figures. In embodiments, the heat sink 146 may be black, FDE or combinations thereof. In further embodiments, the present disclosure contemplates other variations shapes, configurations and positions designed to perform the same or similar function.

In embodiments, body portion 26 and/or 26A may one integrally molded piece. In embodiments, body portion 26A may comprise a thermoplastic polymer material. In one or more embodiments, the body portion 26 may be black, FDE or combinations thereof, and may comprise 30% fiber reinforced nylon.

Figure 5A:
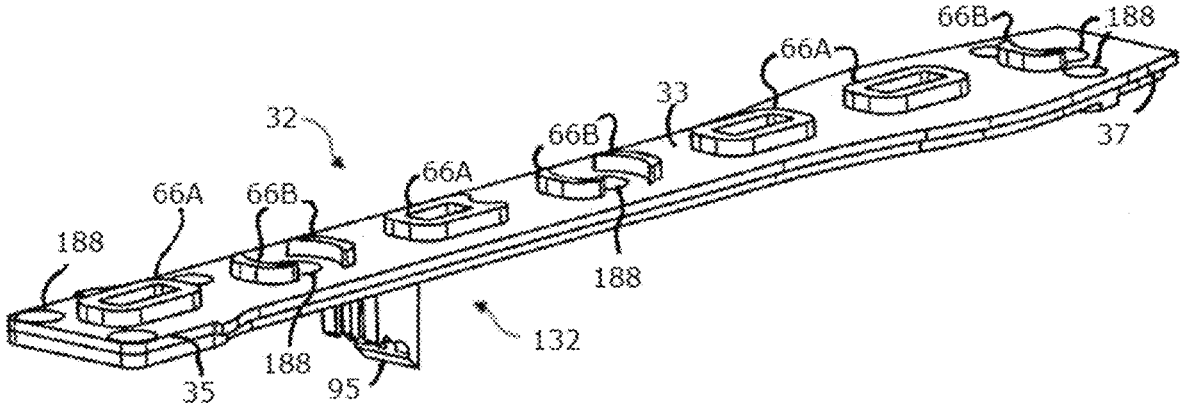
FIG. 5A depicts a top perspective view of a cover portion of the device of FIG. 2A, according to one or more embodiments of the disclosure.
Figure 5B:
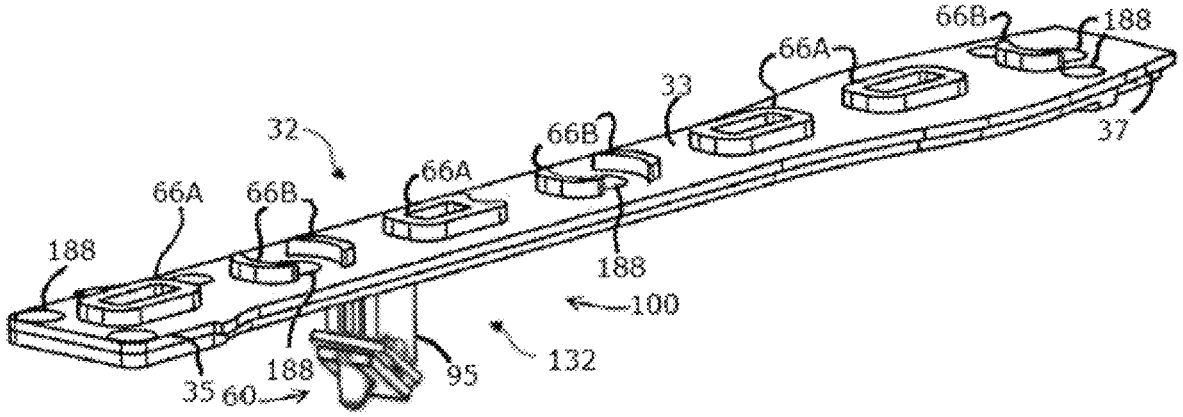
FIG. 5B depicts a top perspective view of the cover portion of FIG. 5A with a mounted activation component, according to one or more embodiments of the disclosure.
Figure 5C:
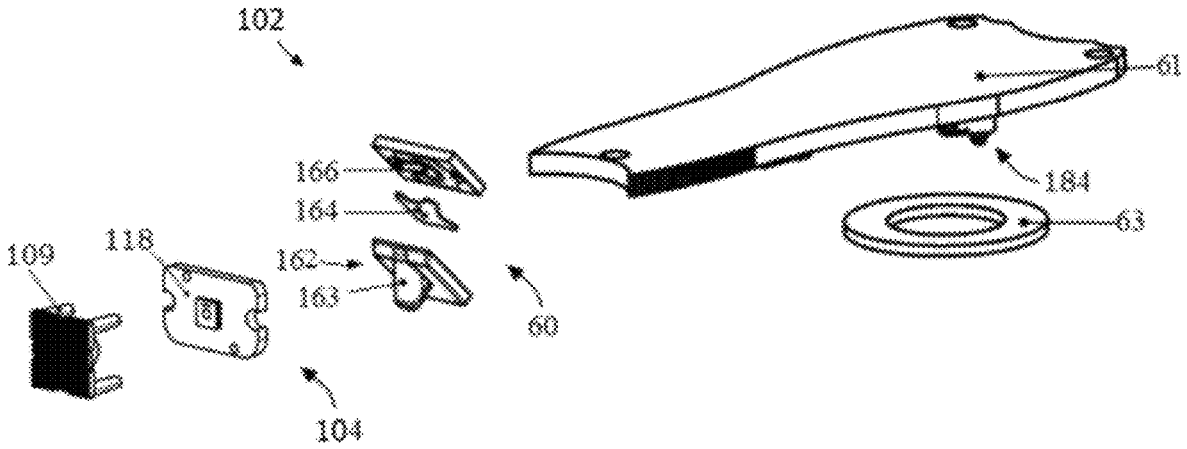
FIG. 5C depicts a right-side top perspective exploded view of an electronic assembly of the device of FIG. 2A, according to one or more embodiments of the disclosure.

Referring to FIGS. 5A-5C, device 12 may include an electronics assembly 100 in one or more embodiments of the disclosure. Electronics assembly 100 may comprise the cover portion 32 and one or more electronic components 102. In one or more embodiments, cover portion 32 has an upper face portion 33 having mounting interfaces 66, which may include a central mounting interface 66A and mounting fastener interfaces 66B, a lower surface portion 133 and a framework structure 132 formed on and extending from lower surface portion 133. When coupled to upper portion 34 of body portion 26 in assembly of device 12, cover portion 32 partially defines upper inner chamber/compartment 79.

In embodiments, cover portion 32 may further include a plurality of openings 188 through upper cover portion 32 corresponding with those in wall 72 of body portion 26 receiving therethrough connectors and/or fasteners, for example, screws 94 and bolts 71, for coupling upper cover portion 32 to body portion 26 and device 12 to a firearm.

In one or more embodiments, framework structure 132 defines one or more seats or recesses and/or mounts 95 for receiving electronic components of the electronics assembly 100. In one or more embodiments, electronic components 102 may be seated and/or mounted on the framework structure 132 of upper cover 32 and positioned to correspond to the framework structure 90 of the body portion 26. FIG. 5B depicts activation components 60 of the electronic components 102 positioned on a mount 95 extending from the upper cover 32.

FIG. 5C is an exploded perspective view of the electronic components 102 in accordance with an embodiment of the disclosure. In one or more embodiments, electronic components 102 may comprise an illumination component or light source 104, one or more activation components 60 for activating the illumination component 104 and a conductor component 61, which may be a main printed circuit board (PCB), in electrical communication with the power source and providing power to the illumination component 104 and one or more activation components 60. In one or more embodiments, main PCB 61 includes contacts 184 electrically and operably connected to the power source and a spacer 63, which may be a battery protection spacer. Examples of main PCB 61, its use, arrangement and function, are described in U.S. patent application Ser. No. 17/465,839, which is herein incorporated by reference in its entirety.

In one or more embodiments, the one or more activation components 60 are operably connected with and used for activating one or more electronic components of device 12, for example, an illumination device 104, such as an LED illumination device 118 and/or a laser module, as described in U.S. patent application Ser. No. 17/465,839, which is herein incorporated by reference in its entirety. In embodiments, activation element/component(s) 60 may include an actuator or activator button 162, which may comprise a protrusion portion 163, with a contact 164, which may be a momentary switch contact, and a circuit 166 (PCB, snap dome), which may be a printed circuit board (PCB), as illustrated in FIG. 5C. In embodiments, activation element/component 60 may comprise an actuator in any suitable form, including buttons, switches, and triggers.

In one or more embodiments, activation component(s) 60 comprises a nylon button 162 with a momentary switch contact 164 on a printed circuit board (PCB) 166. The contact 164 and circuit 166 electrically and operably connects the activator 162 with the one or more electronic devices, such as, for example the illumination device 104.

In an embodiment, activation component 60 comprises a momentary on-off button operably connected to the illumination device 104 via a conductor 61. In embodiments, the protrusion portion 163 of the momentary on-off button may comprise a flexible rubber actuator exposed through an activator opening 91, where it can be closed by the application of slight upward pressure by the user's finger. The momentary on/off button may be a mechanical pressure button, a heat sensitive button, an electrical contact button, or any other suitable button. In alternative embodiments, the button may be of any other operation configuration, including click-on/click-off and such. In embodiments, the button may be operably connected to the illumination device 104 by way of electrically connected contacts and an electrical conductor.

In one or more embodiments, contact 164 is a momentary switch contact in the form of a dome contact snap. An example of a suitable dome contact snap (as illustrated in the Appendix A FIGS.) is a tactile metal dome, when used in conjunction with a printed circuit board, flex circuit, or membrane, become normally-open tactile switches. Tactile metal domes are placed on printed circuit boards by means of pressure-sensitive adhesive tape or they are captured in a pocket design. In their relaxed state, the tactile metal domes rest on the outer rim of the primary pathway. When pushed, the domes collapse and make contact with the secondary pathway, thereby closing the circuit. Switch contacts of different shapes and actuation forces may be used and may be mounted to a variety of switching surfaces, including single or double-sided printed circuit boards, flex circuits, and membrane switch panels, in accordance to specific applications. The switch contacts can be used for electrical contact, tactile-element only, or both electrical and tactile. Such switch contacts may be obtained from Snaptron located in Windsor, Colorado. The switch contact shown in Appendix A FIGS. is part number F06085 from Snaptron. Examples are described in U.S. patent application Ser. No. 17/465,839, which is herein incorporated by reference in its entirety.

In embodiments, activator access openings 91 are formed in body portion 26 to receive and closely conform to the protrusion portions 163 of activators 162. In one or more embodiments, protrusion portion 163, which may comprise a flexible rubber actuator, is exposed through a forward-facing activator opening 91, where it can be closed by the application of slight upward pressure by the user's finger.

In one or more embodiments, when cover portion 32 is coupled to body portion 26 and device 12 is assembled, activation component 60 may be positioned adjacent to and may protrude through activator access opening 91 at an access position. In an embodiment, opening 91 may be forwardly oriented at an acute angle and positioned on or adjacent bisecting plane A-A and in one of or between the trunk portion 136 and the forward tapered portion 48.

In one or more embodiments, access opening 91 is positioned such that a line through opening 91 and perpendicular with the outer surface of body surface 26 is at an angle in the range of 36.00 degrees to 56.00 degrees relative to the longitudinal axis 5 and axis X1 of device 12. In an embodiment, access opening 91 is positioned at an angle in the range of 41.00 degrees to 51.00 degrees relative to axis 5. In further embodiments, access opening 91 is positioned at an angle of about 46.50 degrees relative to axis 5.

In one or more embodiments, the power source 84 is in electrical connection with electronic components 102 of the electronics assembly. Power source 84 may be positioned within lower compartment 80 and covered and secured within the lower compartment 80 by lower cap 83. In embodiments, lower compartment 80 may include a threaded portion for engaging a corresponding threaded portion of lower cap 83 or cover. The lower cap 83 may be slotted to facilitate insertion, tightening and removal of the cap.

In one or more embodiments, device 12 includes inner sleeve 82, wherein the inner sleeve 82 is a metal housing inserted into the lower compartment 80. The metal housing 82 may be sized and configured to receive a power source 84, for example, a battery. In one or more embodiments, metal housing 82 comprises at least a portion of an electrical path between the inserted power source 84 and one or more electronic components 102. In embodiments, the metal housing 82 may be brass tube. In an embodiment, metal housing may be overmolded in the formation of body portion 26. In one or more embodiments, the power source 84 includes a build-in rechargeable battery. In embodiments, the power source may be one 13 N battery or the like.

In one or more embodiments, the illumination source 104 is an LED illumination device 118 and power source 84 is a battery received within lower compartment 80 and electrically connected by terminals in the power source compartment to circuitry. The circuitry may also be electrically connected to the PCA LED board 118 having an LED and flexible circuitry. The momentary on-off button having a flexible rubber actuator is mounted and protrudes through activator access opening 91 below the flexible circuitry and controls the flow of electricity from the battery to the LED 118.

In operation, the light source is activated by pressing or engaging the activator or actuator 162 and/or a rearward activator or actuator, if included, as described in U.S. patent application Ser. No. 17/465,839, which is herein incorporated by reference in its entirety.

In one or more embodiments, the device 12 may further include a laser module (laser diode) as, or in addition to, the illumination source 104. Examples are described in U.S. patent application Ser. No. 17/465,839, which is herein incorporated by reference in its entirety.

In one or more embodiments, forward actuator 162 is in communication with the power source, battery, the main board 61 and the PCA LED board 118. In embodiments, forward rearward activator or actuator 162 may have one or more positions or activation settings, each altering the functioning of the battery module and the PCA LED board 118 to enable the PCA LED board 118 to function in one or more settings, which may include: (1) continuously off; (2) continuously on; and/or (3) on only when the activator is pressed, or both, if a second actuator is included. When activated to be on, the light source 104, or LED, may pulse to save power, while still providing light adequate to illuminate a target.

In one or more embodiments, activator 162 and/or rearward activator, if included, is a momentary activator that is pressed by a user's finger. In an embodiment, the activator(s) functions so that the light source 104, or LED, is activated if pressed. In an embodiment, activator(s) 162 is a slide button. Examples are described in U.S. patent application Ser. No. 17/465,839, which is herein incorporated by reference in its entirety.

In one or more embodiments, the power source, the conductor component/PCB 61 and the activation components 60 are operably and electrically connected. In one or more embodiments, additional or alternative to the ground wire, the inner sleeve or battery tube 82 (battery negative terminal) may be connected to the PCB 61 ground by contacts.

In one or more embodiments, the inner sleeve or battery tube 82 (battery negative terminal) may be connected to the PCB 61 ground with a set of contacts. In one or more embodiments, the set of contacts may be a set of 4 radially placed spring contacts. The contacts may be placed during a surface mount pick and place process that will maintain the ground connection once the device housings are joined or snapped together. When in place, the conductor component/PCB 61 is in electrical communication with the power source and provides power to the illumination component 104 and activation components 60.

In one or more embodiments, the contacts may be spring contacts, or spring finger contacts, examples of which, and their use, are described in U.S. patent application Ser. No. 17/465,839, which is herein incorporated by reference in its entirety.

Figure 8:
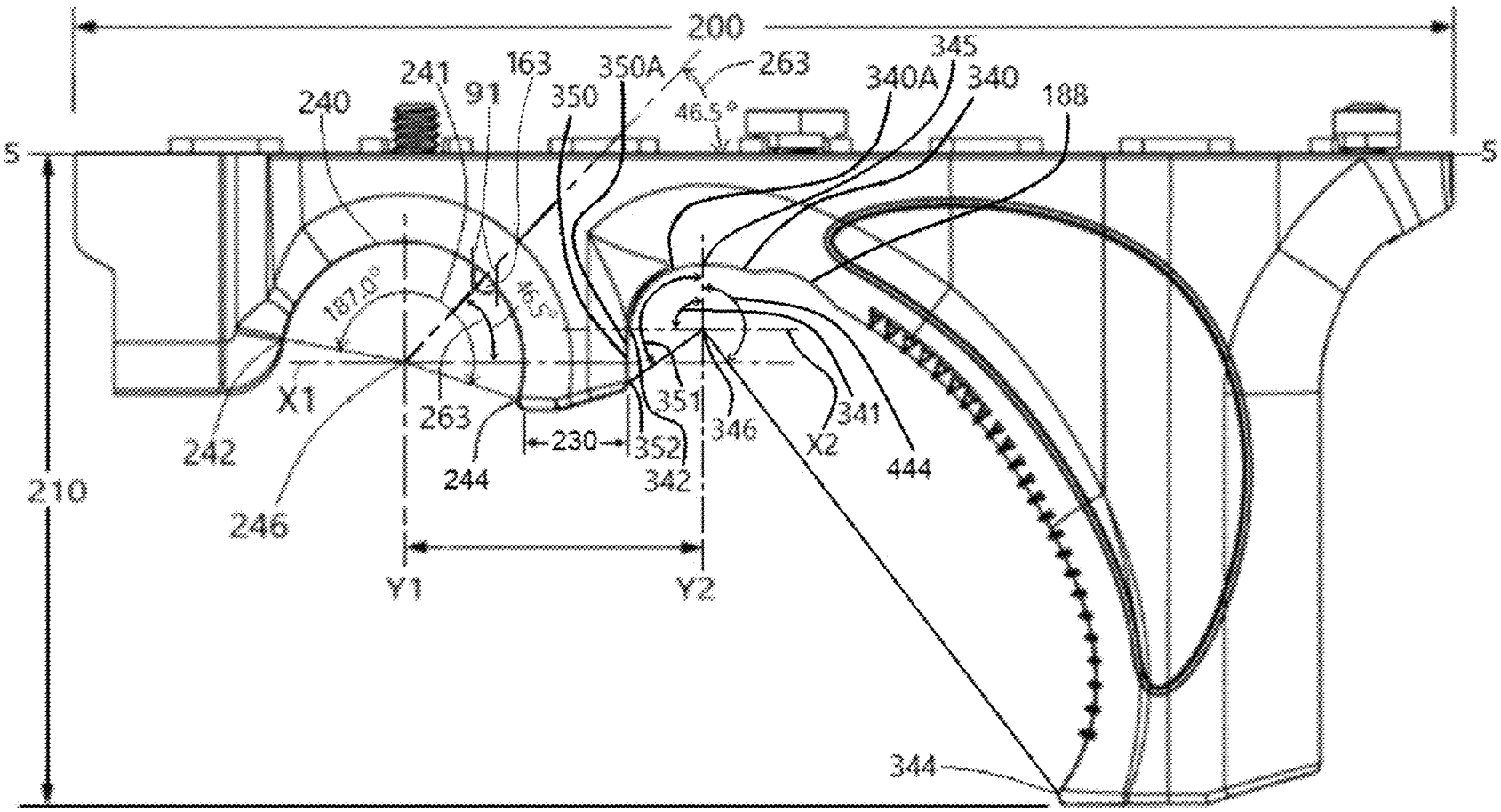
FIG. 8 depicts a left-side elevation view of an accessory device, according to one or more embodiments of the disclosure.

Referring to FIG. 8, a left-side elevation view of a device 12 with various measurements is depicted, according to one or more embodiments. In the embodiment shown, device 12, from a side profile perspective, forms a first forward arc 240 having an arc length from a forward end 242 to a rearward end 244. The first forward arc 240 has a positive curvature along its arc length relative to a center or center of curvature 246, which is the center of an imaginary circle having an x-axis X1 and a y-axis Y1 that best fits the curvature of the first forward arc 240, and a radius of curvature, which, similarly, is the radius of an imaginary circle or circular arc which best approximates the curve of the first arc 240.

In one or more embodiments, central angle 241, from forward end 242 to rearward end 244, is in the range of about 167 degrees to about 210 degrees. In one or more embodiments, central angle 241, from forward end 242 to rearward end 244, is in the range of about 177 to about 197 degrees. In one or more embodiments, central angle 241, from forward end 242 to rearward end 244, is about 187 degrees.

In one or more embodiments, forward activator access opening 91 and at least a portion of forward activator 162, for example protrusion portion 163, are positioned along the first forward arc 240, forming a forward activator angle 263 at center 246, from the x-axis X1, which may be parallel with axis 5. In one or more embodiments, the forward activator angle 263 is in the range of about 36 degrees to about 56 degrees. In some embodiments, the forward activator angle is in the range of about 41.00 degrees to about 51.00 degrees, and in one or more embodiments, the acute angle is about 46.50 degrees.

In the embodiment shown, device 12, from the side profile perspective, forms a first rearward arc 340 having an arc length from a forward end 342 to a rearward end 344. The first rearward arc 340 has a positive curvature along its arc length, excluding opening portion 188, relative to a center or center of curvature 346, which is the center of an imaginary circle having an x-axis X2 and a y-axis Y2 that best fits the curvature of a first portion 340A of the first rearward arc 340 having an arc length from a forward end 342 to a rearward end 345, and a radius of curvature, which, similarly, is the radius of an imaginary circle or circular arc which best approximates the curve of the first portion 340A of the first rearward arc 340. In one or more embodiments, the rearward end 345 may be at or about a high point in the first rearward arc 340 (Y-axis).

In the embodiment shown, device 12, from a side profile perspective, further forms a second rearward arc 350 having an arc length from forward end 352 to rearward end 344. In one or more embodiments, the second rearward arc 350 has a positive curvature along its arc length that overlaps first rearward arc 340 from forward end 342 to rearward end 344 relative to center of curvature 346, and a decreasing, zero or negative curvature from forward end 352 to forward end 342, relative to center of curvature 346. In one or more embodiments, the arc length of second rearward arc 350 from forward end 342 to forward end 352 has a zero or negative curvature substantially, and, in some embodiments, entirely, along its length. In one or more embodiments, the center of curvature of second rearward arc 350 is positioned at, or substantially at, center 346, with a radius of curvature, which is substantially the center of an imaginary circle that best fits the curvature of a first portion 350A of the second rearward arc 350 having an arc length from a forward end 352 to a rearward end 345, and a radius of curvature. As shown in FIG. 8, the second rearward arcs 350, 350A overlap the first rearward arcs 340, 340A. In one or more embodiments, rearward ends 342 and 352 may have about the same position.

In one or more embodiments, central angle 341 may be in the range of about 82 degrees to about 98 degrees. In some embodiments, central angle 341 may be in the range of about 86 degrees to about 94 degrees, and in one or more embodiments, central angle 341 is about 90.00 degrees.

In one or more embodiments, central angle 351 may be in the range of about 116 degrees to about 137 degrees. In some embodiments, central angle 351 may be in the range of about 121 degrees to about 132 degrees, and in one or more embodiments, central angle 351 is about 126 degrees.

In one or more embodiments, central angle 444 from forward end 345 to rearward end 344 may be 125 degrees or more and, in one or more embodiment, the central angle 444 may be in the range of about 131 degrees to about 153 degrees. In some embodiments, central angle 444 may be in the range of about 137 degrees to about 149 degrees, and in one or more embodiments, central angle 444 is about 142.8 degrees.

In one or more embodiments, central angle 341 is about 90 degrees and central angle 351 is about 126 degrees and central angle 444 is about 143 degrees.

In one or more embodiments, device 12, may have a length 200 of about 6.3 inches or less and, in some embodiments, a length 200 of 5.6 inches or less and, in some embodiments, a length 200 of 4.8 inches or less. In some embodiments, the device 12 may have a length 200 of about 5.55 inches or less, a width 220 of about 0.94 inches or less and a height 210 of about 2.62 inches or less. In further embodiments, the device 12 may have a length 200 of about 4.16 inches or less, a width 220 of about 0.71 inches or less and a height 210 of about 1.97 inches or less.

With respect to dimensions and measurements, including distances, angles, curvatures and proportions (including ratios of element to element dimensions and/or measurements), (herein "Dimensions") of device 12, including elements, components and features thereof, given and/or shown above and herein, in one or more embodiments, the dimensions of device 12 are as shown in the figures. In one or more embodiments, the Dimensions of device 12 given and/or shown herein include the range of ±1% of those specified and/or shown. In an embodiment, the Dimensions of device 12 given and/or shown herein include the range of ±2% of those specified and/or shown, and, in a further embodiment, the range of ±3% of those specified and/or shown. In one or more embodiments, the Dimensions of device 12 given and/or shown herein include the range of ±4% of those specified and/or shown, and in a further embodiment, the range of ±5% of those specified and/or shown. In further embodiments, the Dimensions of device 12 given and/or shown herein include the range of ±6%, 8%, 10%, 15% or 20%, distinctly, of those specified and/or shown.

In one or more embodiments, the device is compact and lightweight. In an embodiment, device 12 has a length of about 5.55 inches, a width of about 0.94 inches and a height of about 2.62 inches.

With respect to the dimensions herein, embodiments include any combinations of the given dimensions of device 12, including elements, components and features thereof.

The various measurements specifications depicted in the figures are according to one or more embodiments. It should be understood, however, that the intention is not to limit the disclosure to the particular embodiments described.

The components herein may be conventionally formed of thermoplastic polymers by injection molding.

In one or more embodiments, body portion 26 is of an ergonomic design, having multiple gripping or engagement philosophies. As an example, user may employ a finger wrap hold to pull weapon to shoulder or use the device as a hand/finger-stop, which has an effect of stopping the front hand from entering line of fire or combustion. The curvatures and trunk portion of the devices herein provide for comfortable and secure hand/finger engagement and the positioning of the activators allows for activation within the natural extension of the user's hand/fingers with minimal movement. The device provides for ambidextrous On/Off buttons, intuitive feel in activating the illumination device and aiming and handling of the weapon.

In one or more embodiments, features of the device 12 may include one or more of: a laser module, a digital camera, a video camera with or without audio, instant-on camera activation (programmed and/or sensor triggered), microphone, adjustable tactical light, USB connectivity, password protection, and USB port(s) and system status indicator lights.

FIGS. 9A-9F illustrate various view of an example accessory device 912 (hereinafter, device 912) of a firearm. Device 912 may be the same as or substantially similar to device 12 described above in reference to FIGS. 1-8, except for the differences described herein.

Referring specifically to FIGS. 9A-9F, in one or more embodiments, the device 912 has a forward end 928 and a rearward end 930, and includes a body portion 926. In embodiments, a cover portion 932 is coupled to an upper portion 934 of the body portion 926. Alternatively, or additionally, the cover portion 932 is uniform with the body portion 926.

In one or more embodiments, the body portion 926 includes a first or rear trunk portion 936 and a forward portion 942 forwardly extending from the trunk portion 936. The trunk portion 396 may include an upper body portion 938, a lower body portion 940 and right and left side portions 939, 941.

In one or more embodiments, the forward portion 942 includes a forward end portion 946, a second or forward trunk portion 9136 positioned between the forward end portion 946 and the first trunk portion 936, a first or forward tapered or neck portion 948 positioned between the forward end portion 946 and a second trunk portion 9136, and a second or rearward tapered or neck portion 949 positioned between the first and second trunk portions 936, 9136

Figure 9A:
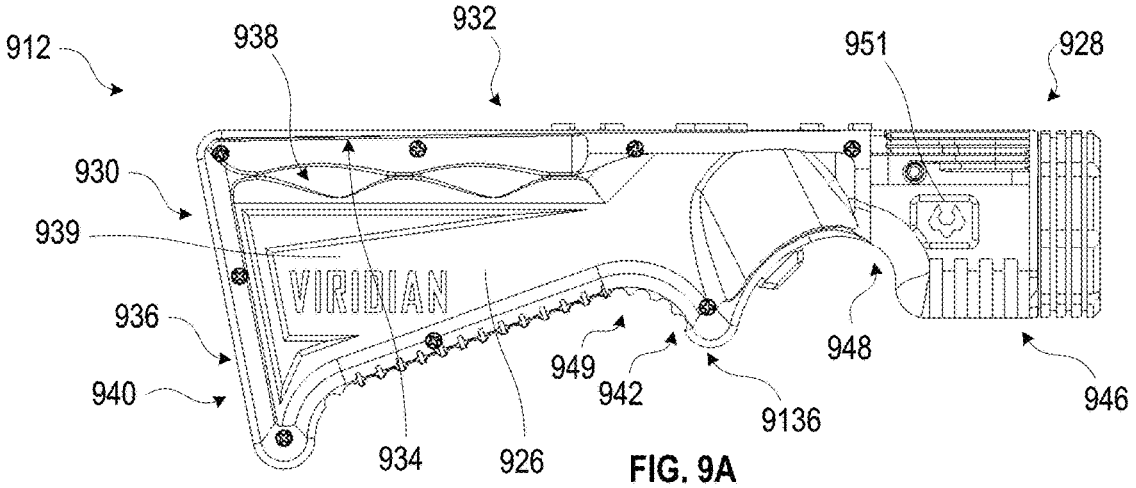
FIG. 9A depicts a right-side elevation view of an accessory device, according to one or more embodiments of the disclosure.
Figure 9B:
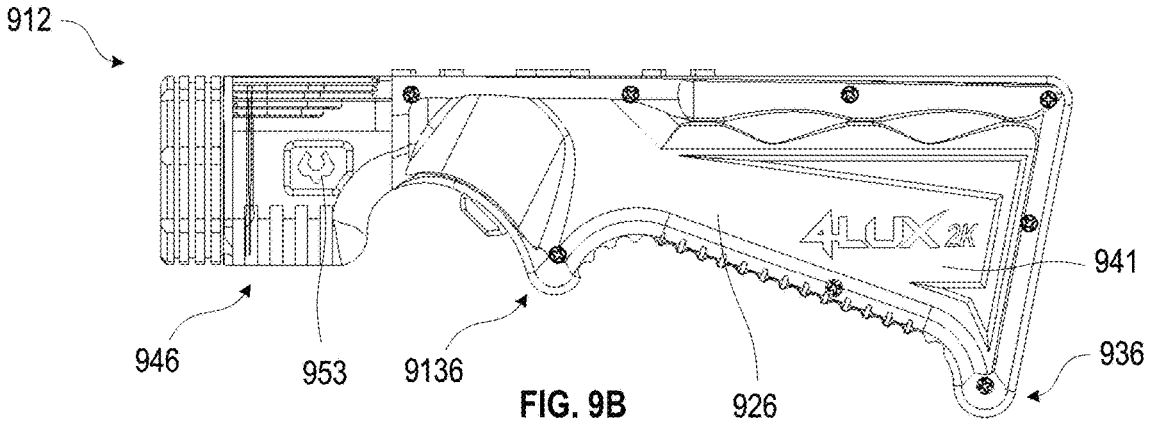
FIG. 9B depicts a left-side elevation view of the device of FIG. 9A, according to one or more embodiments of the disclosure.
Figure 9C:
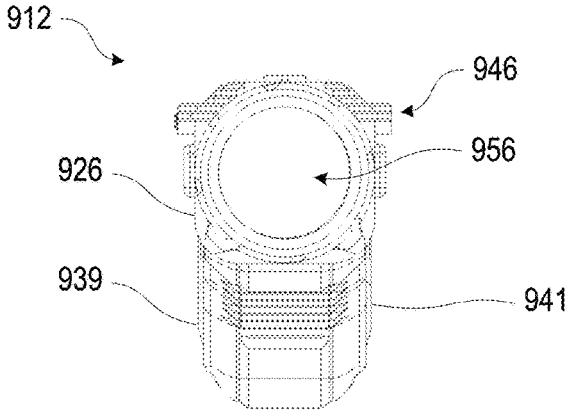
FIG. 9C depicts a front view of the device of FIG. 9A, according to one or more embodiments of the disclosure.
Figure 9D:
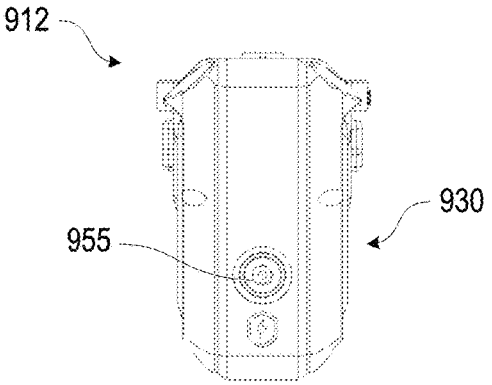
FIG. 9D depicts a rear view of the device of FIG. 9A, according to one or more embodiments of the disclosure.
Figure 9E:
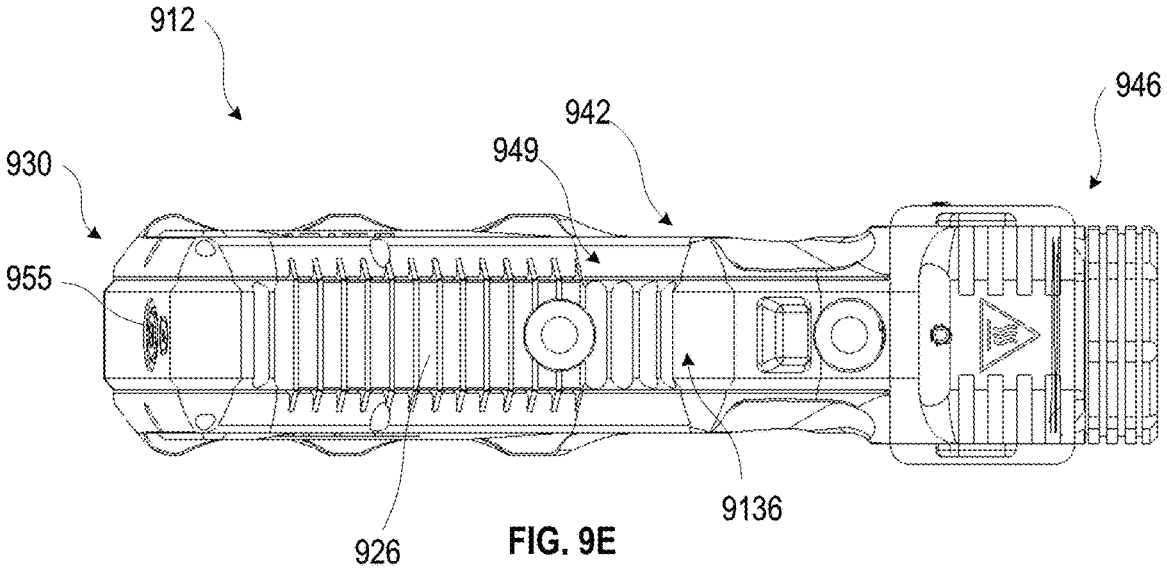
FIG. 9E depicts a bottom plan view of the device of FIG. 9A, according to one or more embodiments of the disclosure.
Figure 9F:
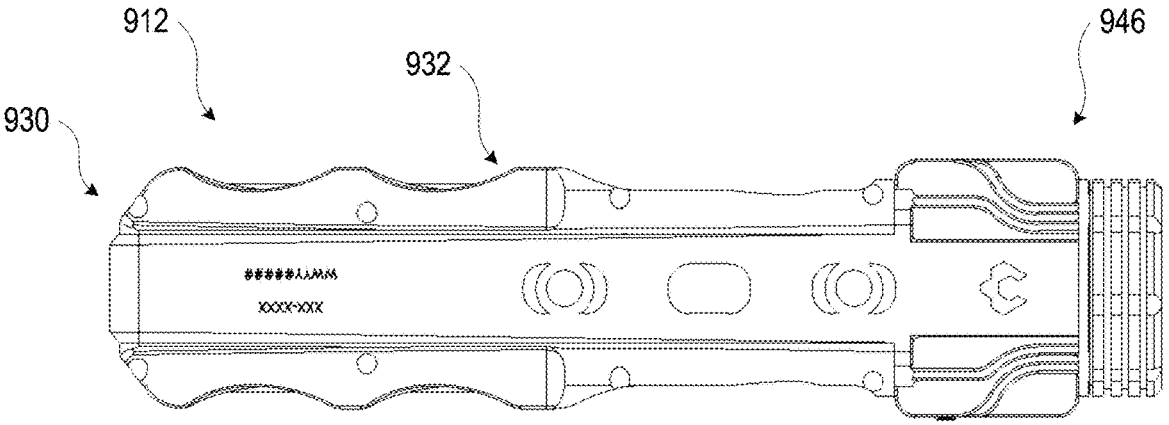
FIG. 9F depicts a top plan view of the device of FIG. 9A, according to one or more embodiments of the disclosure.

Referring specifically to FIG. 9C, in one or more embodiments, aperture 956 provides an outlet for illumination emitted from an illumination device disposed within the body portion 926. In embodiments, aperture 956 may be positioned in a forward-facing wall portion of the forward end portion 946, at or adjacent to a bisecting plane running through forward and rearward end portions 946, 930, between left and right side body portions 941, 939, providing forward facing access to electronic components housed within body portion 926. In embodiments, forward-facing aperture 956 may be covered by a transparent material. In embodiments, the illumination device may have an output up to 2060 lumens. In embodiments, the illumination device may have a peak output of between 2000 and 2500 lumens. In embodiments, the illumination may have an output of up to 222,000 candelas. In embodiments, the illumination device may have a peak output of between 200,000 and 250,000 candelas. In embodiments, the illumination device may have an illumination range of up to about 725 yards. In embodiments, the illumination device may have a peak illumination range of between 650 and 800 yards. In embodiments, the illumination device may have multiple operational modes. For example, the illumination device may have a high setting and a low setting. The high setting may be associated with a peak output and/or a peak illumination range. In embodiments, the low setting may be associated with lower power consumption, thereby allowing the device to function for a longer duration. In one or more embodiments, forward portion 946 may include a right button 951 on right side 939 and a left button 953 on right side 941. Combinations of presses of right and left buttons 951, 953 may enable or alter operational modes of the illumination device. For example, pressing the right button 951 may enable a first operational mode, pressing the left button 953 may enable a second operation mode, and pressing both buttons 951,953 simultaneously may enable a third operational mode. Similarly long presses, for example holding a button for more than a predetermined length of time, may also enable or alter operational modes of the device. Additional operational modes may include, but not be limited to, for example, high beam, low beam, strobe, and ultra-low beam.

In embodiments, in addition to forward facing aperture 956, body portion 926 may further include one or more apertures or outlets for additional electronic components, including, for example, further illumination devices, such as a laser device, and/or recording devices. In embodiments, body portion 926 may be constructed of aluminum. In embodiments, body portion 926 may have a coating, such as a hard coat anodization, to provide impact resistance. In embodiments, body portion 926 may offer protection from dust, moisture, debris, and the like. In embodiments, the device 926 may have an IPX6 environmental and waterproof rating.

In one or more embodiments, device 912 includes a built-in rechargeable battery within the body portion. 926. In such embodiments, device 912 may further include a charge port 955, for example, on rearward end 930. Charge port 955 is in electrical communication with the battery or battery systems located within the body portion 926. In embodiments, charge port 955 may be a magnetic or a quick release port. In embodiments, the device 12 may operate up to 90 minutes on a single charge at peak illumination. In embodiments, the device 12 may operate between 60 and 120 minutes on a single charge at peak illumination.

FIGS. 10A-10G illustrate various view of an example accessory device 1012 (hereinafter, device 1012) of a firearm. Device 1012 may be the same as or substantially similar to one or more of device 12 described above in reference to FIGS. 1-8 and or device 912 described above in reference to FIGS. 9A-9F, except for the differences described herein.

Referring specifically to FIGS. 10A-10G, in one or more embodiments, the device 1012 has a forward end 1028 and a rearward end 1030, and includes a body portion 1026. In embodiments, a cover portion 1032 is coupled to an upper portion 1034 of the body portion 1026. Alternatively, or additionally, the cover portion 1032 is uniform with the body portion 1026.

In one or more embodiments, the body portion 1026 includes a first or rear trunk portion 1036 and a forward portion 1042 forwardly extending from the trunk portion 1036. The trunk portion 1096 may include an upper body portion 1038, a lower body portion 1040 and right and left side portions 1039, 1041.

In one or more embodiments, the forward portion 1042 includes a forward end portion 1046, a second or forward trunk portion 10136 positioned between the forward end portion 1046 and the first trunk portion 1036, a first or forward tapered or neck portion 1048 positioned between the forward end portion 1046 and the second trunk portion 9136, and a second or rearward tapered or neck portion 1049 positioned between the first and second trunk portions 1036, 10136.

Figure 10A:
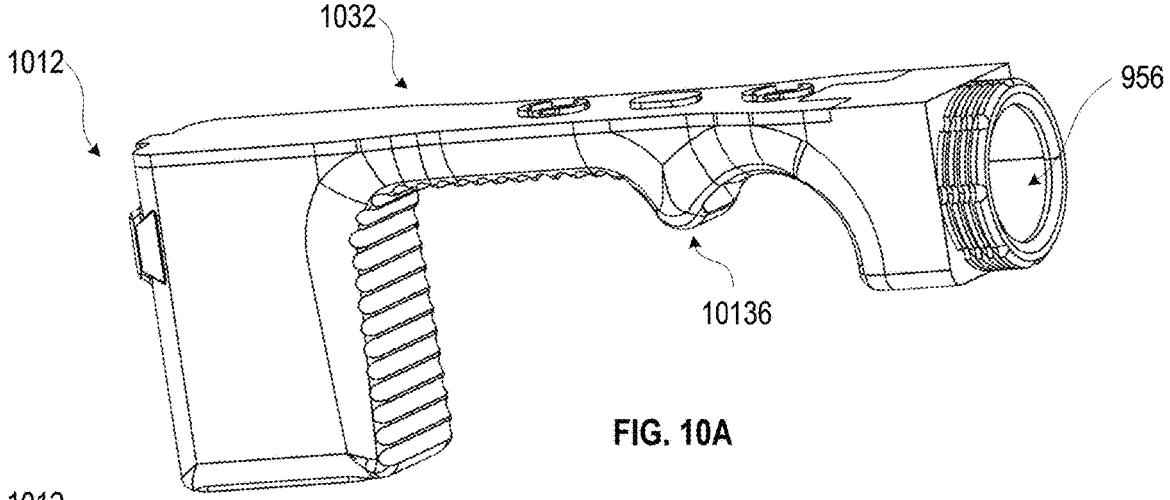
FIG. 10A depicts a right-side, top, front perspective view an accessory device, according to one or more embodiments of the disclosure.
Figure 10B:
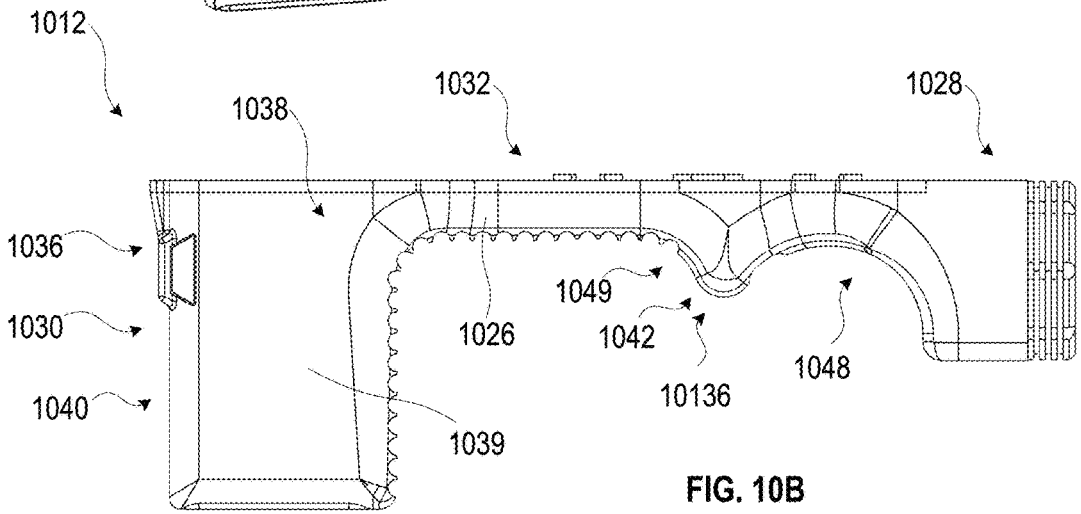
FIG. 10B depicts a right-side elevation view of the device of FIG. 10A, according to one or more embodiments of the disclosure.
Figure 10C:
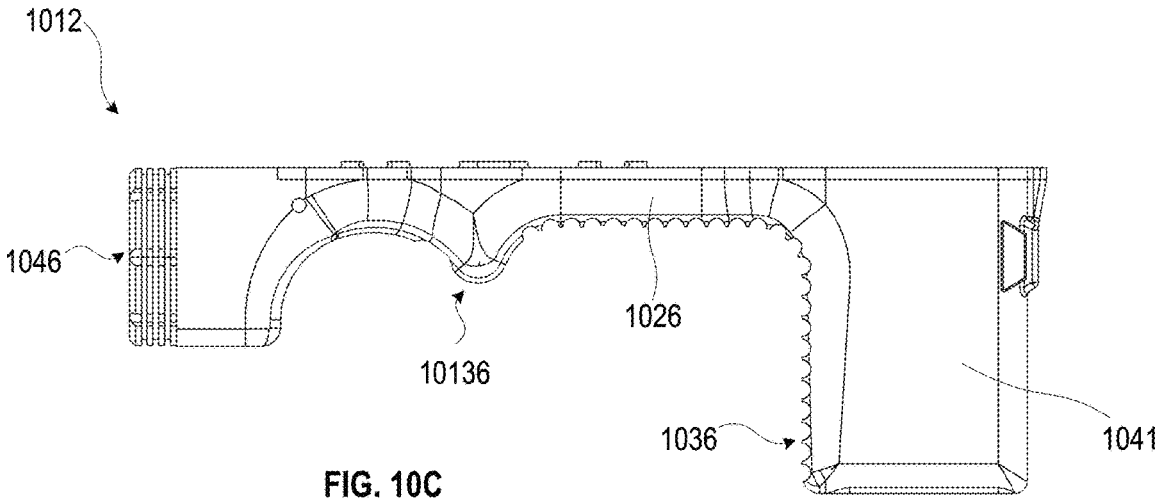
FIG. 10C depicts a left-side elevation view of the device of FIG. 10A, according to one or more embodiments of the disclosure.
Figure 10D:
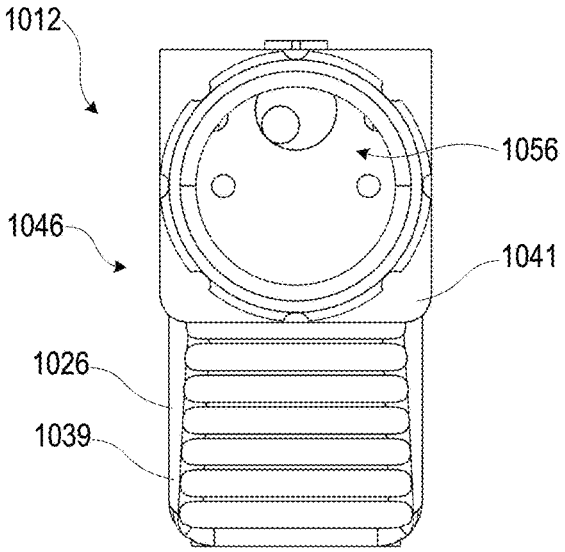
FIG. 10D depicts a front view of the device of FIG. 10A, according to one or more embodiments of the disclosure.
Figure 10E:
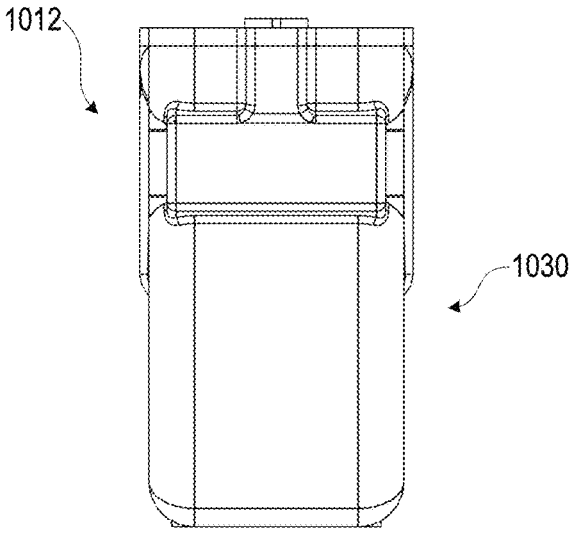
FIG. 10E depicts a rear view of the device of FIG. 10A, according to one or more embodiments of the disclosure.
Figure 10F:
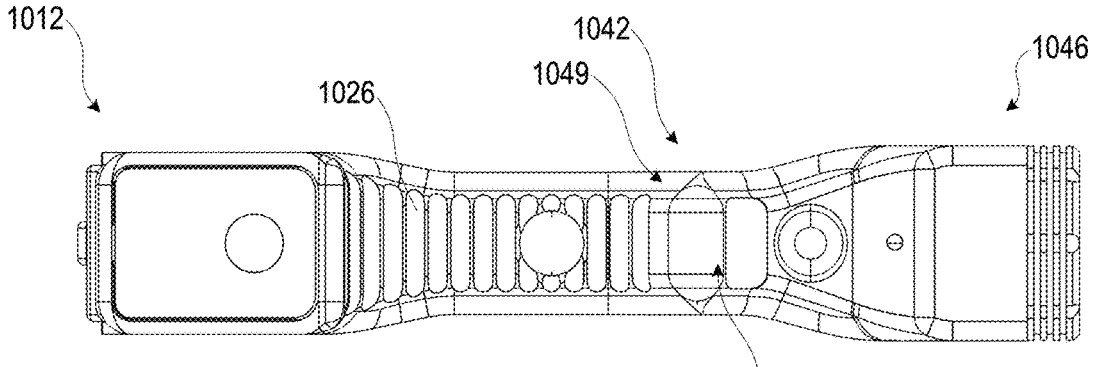
FIG. 10F depicts a bottom plan view of the device of FIG. 10A, according to one or more embodiments of the disclosure.
Figure 10G:
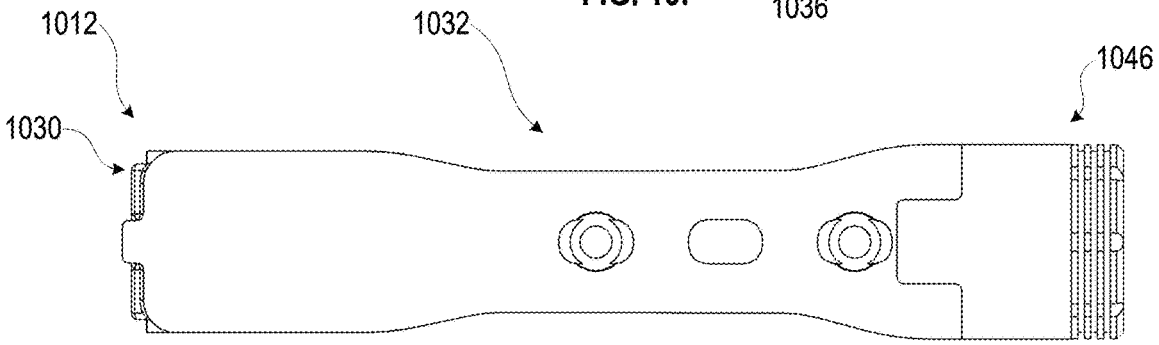
FIG. 10G depicts a top plan view of the device of FIG. 10A, according to one or more embodiments of the disclosure.

Referring specifically to FIG. 10D, in one or more embodiments, aperture 1056 provides an outlet for illumination emitted from an illumination device disposed within the body portion 1026. In embodiments, aperture 1056 may be positioned in a forward-facing wall portion of the forward end portion 1046, at or adjacent to a bisecting plane running through forward and rearward end portions 1046, 1030, between left and right side body portions 1041, 1039, providing forward facing access to electronic components housed within body portion 1026. In embodiments, forward-facing aperture 956 may be covered by a transparent material.

U.S. Pat. Nos. 11,306,987; 10,532,275; 10,436,553; 10,436,538; 10,365,069; 10,323,903; 10,260,841; 10,222,171; 10,209,033; 10,209,030; 10,132,595; 10,060,701; 9,696,111; 9,658,031; 9,476,672; 9,182,194; 8,844,189; 8,807,779; 8,662,694; 8,595,970; 8,312,665; 8,182,109; 8,127,486; 8,127,485; 8,001,715; 7,827,726; 6,705,038; 6,571,503; 6,282,829; 6,219,952; 6,185,854; 5,905,238; 5,448,834; 5,446,535; 5,430,967; 5,241,146; 5,208,826; 4,894,941; 4,234,911; 4,232,867; 4,144,505; 3,992,783; 3,573,868; 3,526,972; 3,510,965; 3,284,905; 3,112,567; 2,904,888; 2,844,710; 2,780,882; 2,773,309; 2,430,469; 2,268,056; 1,898,566; D790651; D790650; D786384; D786383; D487791; D368121; D873946; and D672005 are hereby incorporated by reference herein in their entirety for all purposes. In addition, U.S. Publication Nos.: 2004/0244259; 2006/0204835; 2010/0178540; 2015/0184978; 2017/0155269; 2016/0061560; 2018/0106568; 2018/0238649; 2018/0299217; 2018/0321015; 2019/0063864; 2019/0222771; 2015/0233668; 2014/0355258; 2014/0109457; 2014/0007485; 2013/0185978: 2012/0144718; 20110047851; 2012/0144716; 2011/0138667; 2011/0107643; 2011/0074303; 2007/0039226; 2005/0130739; 2004/0003529; 2002/0134000; 2002/0129536; 2002/0073561; 2002/0057719; 2002/0009694; and 2001/0042335 are hereby incorporated by reference herein in their entirety for all purposes. In addition, U.S. patent application Ser. No. 17/465,839, filed Sep. 2, 2021; U.S. Provisional Patent Application No. 63/073,573, filed Sep. 2, 2020; U.S. Provisional Patent Application No. 63/140,174, filed Jan. 21, 2021; and U.S. Design patent application No. 29/749,088, filed Sep. 2, 2021, and Ser. No. 29/904,291, filed Oct. 3, 2023, are incorporated herein by reference in their entireties. Components illustrated in such patents may be utilized with embodiments herein. Incorporation by reference is discussed, for example, in MPEP section 2163.07(B).

The patents, patent publications and other references mentioned above in all sections of this application are herein incorporated by reference in their entirety for all purposes. All the features disclosed in this specification (including the references incorporated by reference, including any accompanying claims, abstract and drawings and the accompanying Appendix A), and/or all of the steps of any method or process so disclosed, may be combined in any combination, except combinations where at least some of such features and/or steps are mutually exclusive. The invention is not restricted to the details of the foregoing embodiment(s). The invention extends to any novel one, or any novel combination, of the features disclosed in this specification (including any incorporated by reference references, any accompanying claims, abstract and drawings and accompanying Appendix A), or to any novel one, or any novel combination, of the steps of any method or process so disclosed.

The descriptions of the various embodiments of the present disclosure have been presented for purposes of illustration but are not intended to be exhaustive or limited to the embodiments disclosed. Many modifications and variations will be apparent to those of ordinary skill in the art without departing from the scope and spirit of the described embodiments. The terminology used herein was chosen to explain the principles of the embodiments, the practical application or technical improvement over technologies found in the marketplace, or to enable others of ordinary skill in the art to understand the embodiments disclosed herein.

What is claimed is:

1. A device configured as an accessory for a firearm, comprising:

a housing removably attachable to the firearm, the housing having an axis through a forward end and a rearward end of the housing and comprising a body portion downwardly extending from a cover portion, wherein the body portion includes a first trunk portion, a forward portion extending forwardly from an upper portion of the first trunk portion, the forward portion comprising a second trunk portion extending downwardly forward of the first trunk portion, the forward portion having a first tapered neck portion between the first trunk portion and the second trunk portion and a second tapered neck portion between the second trunk portion and a forward end portion;

an aperture formed in the forward end of the housing;

an illumination device engaged by an internal seat disposed within the housing, the illumination device being configured to emit light through the aperture;

an activation device extending through the housing, the activation device being operably connected to the illumination device and a power supply, wherein actuation of the activation device directs power from the power supply to the illumination device; and a coupling mechanism for coupling the housing to the firearm, wherein the activation device, the first trunk portion, and the second trunk portion each intersect a common plane.

2. The device of claim 1, wherein the illumination device is an LED.

3. The device of claim 1, wherein the common plane approximately vertically bisects the device.

4. The device of claim 1, wherein the illumination device and the aperture each intersect the common plane.

5. The device of claim 1, wherein the activation device at least partially extends through a first opening in the body portion of the housing at an angle between an adjacent plane defined by the housing and a line through and perpendicular to the first opening in a range of about 36 degrees to about 56 degrees.

6. The device of claim 1, wherein the device is rigidly connectable to a forend of the firearm.

7. The device of claim 1, wherein the housing defines inner framework structure including at least one of a compartment, a chamber, a mount, and a seat.

8. The device of claim 7, wherein the inner framework structure is integral with a wall of the housing.

9. The device of claim 1, wherein the first trunk portion comprises a left side wall portion and a right side wall portion separated by the common plane.

10. The device of claim 1, wherein the housing is formed of aluminum.

11. The device of claim 1, wherein the forward portion and the first trunk portion are configured to be positioned immediately below a barrel of the firearm.

12. A device removably attachable to a firearm, the device comprising:

a body having a middle tapered neck portion between a forward trunk portion and a rearward trunk portion and a forward tapered neck portion between the forward trunk portion and a forward end portion, the forward trunk portion and the rearward trunk portion each having an upper portion and a lower portion, wherein, when the device is mounted to the firearm, the upper portion of each of the forward trunk portion and the rearward trunk portion are proximal to the firearm, wherein an outermost cross-sectional perimeter of the forward end portion is greater than any cross-sectional perimeter of the forward tapered neck portion;

an inner chamber defined by a wall of the body and configured to receive an illumination device therein;

an activation device extending through the body portion, wherein the activation device is configured to direct power from a power supply to the illumination device, and wherein the activation device at least partially extends through a first opening in the body at an angle between an adjacent plane defined by the body and a line through and perpendicular to the first opening; and a coupling mechanism for coupling the body to the firearm.

13. The device of claim 12, wherein the forward trunk portion and the rearward trunk portion each intersect a common plane.

14. The device of claim 12, further comprising the illumination device, wherein the illumination device comprises one or more LEDs.

15. The device of claim 14, wherein, when the activation device is actuated, illumination from the illumination device emits through an aperture defined by the forward end portion of the body.

16. The device of claim 13, wherein the common plane approximately vertically bisects the device.

17. The device of claim 12, wherein the angle is in a range of about 36 degrees to about 56 degrees.

18. An illumination device comprising:

a housing, the housing defining an inner chamber and having a first trunk portion vertically oriented between an upper portion and a lower portion, a forward portion extending forward from the first trunk portion, a second trunk portion oriented forward of the first trunk portion and extending from the forward portion, a forward neck portion between the second trunk portion and a forward end portion, and a rearward neck portion between the first trunk portion and the second trunk portion, wherein, when viewed from a side profile perspective, the housing forms a first forward arc having an arc length from a forward end to a rearward end, the first forward arc having a positive curvature along its arc length relative to a forward center or forward center of curvature;

an illumination device disposed within the inner chamber defined by a wall of the housing; and an activation device accessible from outside of the housing, through a forward activator access opening in at least the first forward arc, the activation device being operably connected to the illumination device and a power supply, wherein engagement with the activation device directs power from the power supply to the illumination device.

19. The illumination device of claim 18, wherein, when viewed from a side profile perspective, the illumination device further forms a first rearward arc having a second arc length from a forward end to a rearward end.

20. The illumination device of claim 18, wherein at least a portion of the activation device defines a forward activator angle at the forward center, from an x-axis.

* * * * *